US007900929B2

(12) United States Patent
Takasugi

(10) Patent No.: US 7,900,929 B2
(45) Date of Patent: Mar. 8, 2011

(54) PRIZE ACQUISITION GAME DEVICE

(75) Inventor: Kouki Takasugi, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 43 days.

(21) Appl. No.: 12/440,971

(22) PCT Filed: Sep. 10, 2007

(86) PCT No.: PCT/JP2007/067587
§ 371 (c)(1),
(2), (4) Date: Mar. 12, 2009

(87) PCT Pub. No.: WO2008/032672
PCT Pub. Date: Mar. 20, 2008

(65) Prior Publication Data

US 2009/0278318 A1 Nov. 12, 2009

(30) Foreign Application Priority Data

Sep. 13, 2006 (JP) ..... 2006-247571

(51) Int. Cl.
*A63F 9/30* (2006.01)

(52) U.S. Cl. ..... 273/447

(58) Field of Classification Search ..... 273/447, 273/448
See application file for complete search history.

(56) References Cited

U.S. PATENT DOCUMENTS 6,957,813 B2 * 10/2005 Verstraeten ..... 273/448
2006/0170164 A1 * 8/2006 Watanabe ..... 273/447
2007/0013139 A1 * 1/2007 Kumagai ..... 273/448
2009/0278318 A1 * 11/2009 Takasugi ..... 273/448
2010/0090408 A1 * 4/2010 Fukazawa et al. ..... 273/447

FOREIGN PATENT DOCUMENTS

JP 05076656 A * 3/1993

(Continued)

OTHER PUBLICATIONS

International Search Report mailed on Dec. 11, 2007 in international application No. PCT/JP2007/067587.

(Continued)

*Primary Examiner* — Raleigh W. Chiu
(74) *Attorney, Agent, or Firm* — Finnegan, Henderson, Farabow, Garrett & Dunner, L.L.P.

(57) ABSTRACT

To perform angle adjustment of a claw member in an end portion of a gripping arm assuredly in a simple manner. A claw member 4 is disposed to be able to turn relative to an arm 8 in the direction for opening or closing the arm 8, and a claw angle adjusting means 42 that can be switched between a restricted state in which a relative angle of the claw member 4 with respect to the arm 8 is fixed by restricting a turning operation of the claw member 4 relative to the arm 8 and a non-restricted state in which the relative angle of the claw member 4 can be changed by allowing the turning operation of the claw member 4 by a user's manual operation is included. The claw angle adjusting means 42 has a slider 43 that can be moved between a restricted position and a non-restricted position. In addition, a stair part 44 that has multiple steps and forms the restricted state of the claw angle adjusting means 42 by engaging an engagement part 43*a* that is a part of the slider 43 is disposed.

14 Claims, 23 Drawing Sheets

FOREIGN PATENT DOCUMENTS

| | | | | |
|---|---|---|---|---|
| JP | 10-211355 | | | 8/1998 |
| JP | 2001157772 | A | * | 6/2001 |
| JP | 2003-022730 | | | 1/2003 |
| JP | 2003053020 | A | * | 2/2003 |
| JP | 2003-190622 | | | 7/2003 |
| JP | 2004-057271 | | | 2/2004 |
| JP | 3103968 | | | 6/2004 |
| JP | 2005-237939 | | | 9/2005 |
| JP | 2006-043269 | | | 2/2006 |
| JP | 2006-061215 | | | 3/2006 |
| JP | 2006-223406 | | | 8/2006 |

OTHER PUBLICATIONS

Extended European Search Report mailed on Mar. 1, 2010, in European application No. EP 07828230 (4 pages).

* cited by examiner

PRIZE ACQUISITION GAME DEVICE

CROSS REFERENCE TO RELATED APPLICATIONS

This application is a national phase application based on international application number PCT/JP2007/067587, filed Sep. 10, 2007, and claims priority of Japanese Patent Application No. 2006-247571, filed Sep. 13, 2006, the contents of both of which are incorporated herein by reference.

BACKGROUND OF THE INVENTION

1. Technical Field

The present invention relates to a prize acquisition game device. Described in more detail, the present invention relates to improvement of a game device used for a game for acquiring a prize, for example, by using a pair of arms that can be opened or closed.

2. Description of Related Art

Prize acquisition game devices such as crane game devices for acquiring a prize (for example, a stuffed toy or the like) housed inside a casing provide fun in the operation thereof and encourage player's motivations for challenging a game by using a popular character or the like as the prize. Thus, many prize acquisition game devices have been installed not only to game centers but also to general stores, shopping malls, and the like. Conventionally, various types of the prize acquisition game devices have been proposed and commercialized.

As the above-described prize acquisition game device, a device in which a pair of opening/closing arms having claws attached thereto is disposed, for example, in a UFO-like shaped grip part is frequently used. In such a case, first, the grip part is moved horizontally inside a casing in response to a player's operation, then performs an operation for opening and closing the arms right below the current position, is additionally moved to a position right above a prize receiving opening, and performs an operation for opening and closing the arms again. In such a series of operations, if a prize is gripped and lifted, for example, by using the claws disposed in the ends of the arms and is moved to a position right above the prize receiving opening without being dropped, the prize can be obtained.

In such a prize acquisition game device, the easiness of gripping a prize is changed in accordance with the state (for example, an attachment angle with respect to the arms or the like) of the claws disposed in the ends of the arms, and thereby the degree of difficulty for acquisition of the prize is changed. Thus, prize acquisition game devices in which an attachment angle of the claw in the end of the arm can be arbitrarily changed by a service provider side (a game center or a general store, or the like) of the prize acquisition game have been proposed (for example, see Patent Documents 1 to 3).

Patent Document 1: Japanese Patent Application Publication Laid-Open No. 2005-237939

Patent Document 2: Japanese Patent Application Publication Laid-Open No. 2003-190622

Patent Document 3: Japanese Registered Utility Model No. 3103968

SUMMARY OF THE INVENTION

Although the attachment angle of the claw in the end of the arm can be arbitrary changed, however, the operation may not be performed simply and assuredly for example, in the above-described conventional devices.

The object of the present invention is to provide a prize acquisition game device capable of performing angle adjustment of a claw member in an end portion of the gripping arm simply and assuredly.

In order to solve the above-described problem, the inventor of the present invention went through various considerations. As described above, the background for enabling the service provider side to arbitrarily change the attachment angle of the claw in the end of the arm is that the claw state in the end of the arm has an important effect upon a game, as is performed in the above-described game device, in which a prize is obtained by gripping and lifting the prize using the arm and moving the prize in the state. In other words, in a series of operations for inserting the claw into a gap between piled prizes and hooking and lifting a part of a prize, the shape and the attachment angle of the claw are important. Accordingly, by slightly changing the shape and the attachment angle of the claw, the degree of difficulty for the game (easiness in acquiring a prize) is changed markedly. In particular, changing the attachment angles of the claws with respect to the arms is not as troublesome as replacing all the claws and can change the easiness of acquisition of a prize in a simple manner. Thus, when the kind or size of a prize is changed or the easiness of acquisition of a prize is to be changed in accordance with a policy of the store side, the change of the attachment angle of the claw is useful as simple means for changing the easiness of acquisition of a prize (the degree of difficulty of a game) in a simple manner.

In the above-described viewpoint, since the attachment angle of the claw can be changed without preparing a plurality of types of claw members having different angles in the conventional game devices as described above, the conventional game devices are useful. However, an operation for loosening a fastening screw first, changing the angle, and fastening the fastening screw again, for example, by using a driver, is troublesome. In addition, the adjustment operation may be unexpectedly difficult in a case where the claw is slipped or deviated in fastening the screw after setting the angle to a desired angle. In addition, when the claw is slipped or deviated as described above, there is a case that the original position cannot be known and the adjustment operation should be retried, and thus, there is insufficient reproducibility. Consequently, there may be a case where a desired angle is not implemented and the adjustment operation should be repeated several times.

In consideration of the above-described viewpoints, the inventor has repeatedly reviewed the problems of the conventional technology as described above, and has finally acquired technology for solving the problems. The present invention is based on the acquired technical findings. According to a first aspect of the invention, there is provided a prize acquisition game device that can perform a game for gripping and acquiring a prize, the prize acquisition game device including: a grip part that is moved in a predetermined space in response to an external operation; an arm that is attached to the grip part to be able to be opened or closed and performs an operation for gripping the prize as a target for acquisition or separating the gripped prize; a claw member that is attached to an end portion of the arm; and claw angle adjusting means that is switchable between a restricted state in which a relative angle of the claw member with respect to the arm is fixed by restricting a turning operation of the claw member relative to the arm and a non-restricted state in which the relative angle can be changed by allowing the turning operation of the claw member by a user's manual operation. The claw member is disposed to be able to turn relative to the arm in the direction for opening or closing the arm.

In the above-described prize acquisition game device, the claw angle adjusting means that restricts or allows the turning operation of the claw member can be switched by a manual operation, and accordingly, a user such as a service provider can change the angle of the claw member with respect to the arm without using a tool or the like. In other words, the relative angle of the claw with respect to the arm can be simply adjusted by switching the claw angle adjusting means to the non-restricted state by a manual operation, changing the relative angle of the claw member, and switching the claw angle adjusting means back to the restricted state by a manual operation. For example, in a case where a fastening screw is used, a series of operations for loosening the fastening screw first, adjusting the angle, and then fastening the fastening screw again is needed. In addition, a tool such as a driver is required to be used. However, according to the above-described prize acquisition game device, the angle adjustment can be performed in a simple manner. In addition, in a case where a conventional configuration in which the fastening screw is loosened and then fastened tightly again is used, when the screw is to be tightly fastened, a slip or deviation may occur. However, since a fastening operation is not performed for the above-described prize acquisition game device, a slip or deviation due to the fastening operation does not occur. Accordingly, angle adjustment of the claw member can be performed more assuredly for the above-described prize acquisition game device than for the conventional prize acquisition game device.

In the above-described prize acquisition game device, the claw angle adjusting means may include a slider that can be moved between a restricted position for restricting the turning operation of the claw member and a non-restricted position for allowing the turning operation of the claw member. In such a case, a user can perform the angle adjustment by a simple operation of moving the slider to the non-restricted position, turning the claw member by a desired angle, and returning the slider to the non-restricted position. Accordingly, the angle adjustment operation can be performed simply and assuredly.

The above-described prize acquisition game device may further include a stair part having a plurality of steps in which an engagement part that is a part of the slider is engaged for switching the claw angle adjusting means to the restricted state. In such a case, when the engagement part of the slider is engaged with any one step of the stair part, the claw angle adjusting means can be switched to the restricted state, and accordingly, the angle adjustment can be performed by a simple operation. In addition, when the slider is engaged with any one step of the stair part, a specific claw angle determined by the position of the stair part can be set, and accordingly, an accurate angle adjustment operation can be easily performed.

In such a case, it is preferable that a biasing member that biases the slider to the restricted position side is further included. When an operation other than the claw angle adjustment is performed (for example, during a game is played), a deviation of the slider to the non-restricted position side is suppressed by biasing the slider to the restricted position side using the biasing member. In addition, in order to adjust the claw angle, the slider is moved against the biasing force, and thus the angle adjustment can be performed by a simple operation.

Alternatively, in the above-described prize acquisition game device, the stair part may be shaped to include an engaging hole having a width slightly smaller than the engagement part of the slider that is inserted into the stair part to be in an engaged state and serving to prevent the engagement part from being easily disengaged. In such a case, the engagement part engaged with the engaging groove is in a state that the engagement part is not easily disengaged from the engaging groove, and thus, the restricted state can be easily maintained unless a user (for example, a service provider side such as a game center or a store) performs an operation.

In addition, it is preferable that the stair part is disposed in the slider and is engaged with an end portion of the claw member.

In addition, it is preferable that the width of the slider in the direction for opening or closing the arm is smaller than that of the arm, and the slider is disposed such that both sides of the slider are positioned on the inner side relative to both sides of the arm. When the slider protrudes from the side part of the arm or the like, the protruded portion may be caught on a prize. However, when the width of the slider is smaller than that of the arm and the slider is disposed not to protrude from both sides of the arm, there is a rare case that the slider is caught on a prize, and thereby the prize acquisition game is not influenced.

According to a second aspect of the present invention, there is provided a prize acquisition game device that can perform a game for gripping and acquiring a prize. The prize acquisition game device includes: a grip part that is moved in a predetermined space in response to an external operation; an arm that is attached to the grip part to be able to be opened or closed and performs an operation for gripping the prize as a target for acquisition or separating the gripped prize; a claw member that is attached to an end portion of the arm; and claw angle adjusting means including: a slider that can be moved along the claw member between a restricted position for restricting a turning operation of the claw member and a non-restricted position for allowing the turning operation of the claw member; a stair part having a plurality of steps formed in the arm so as to restrict the turning operation of the claw member by being engaged with an engagement part that is a part of the slider; and a biasing member that biases the slider to the restricted position for engaging the slider with the stair part. The claw member is disposed to be able to turn relative to the arm in the direction for opening or closing the arm.

According to a third aspect of the present invention, there is provided a prize acquisition game device that can perform a game for gripping and acquiring a prize. The prize acquisition game device includes: a grip part that is moved in a predetermined space in response to an external operation; an arm that is attached to the grip part to be able to be opened or closed and performs an operation for gripping the prize as a target for acquisition or separating the gripped prize; a claw member that is attached to an end portion of the arm; and claw angle adjusting means including: a slider that can be moved between a restricted position for restricting a turning operation of the claw member and a non-restricted position for allowing the turning operation of the claw member within the arm; a stair part having a plurality of steps formed in the claw member so as to restrict the turning operation of the claw member by being engaged with an engagement part that is a part of the slider; and a biasing member that biases the slider to the restricted position for engaging the slider with the stair part. The claw member is disposed to be able to turn relative to the arm in the direction for opening or closing the arm.

In the above-described prize acquisition game device, a resistance reducing portion in the shape corresponding to the direction for opening or closing the arm may be formed in at least a part of a claw that is formed in the claw member. In such a case, the contact area between the face of the claw on which the concave parts are formed and a prize decreases, and the concave parts are formed along the direction for opening or closing the arm. Accordingly, the resistance of the prize loaded in the claw decreases, and thereby the prize can easily slide on the surface of the claw. As a result, the resistance reducing portion may be effectively used as means for increasing the degree of difficulty of prize acquisition.

Alternatively, in the above-described prize acquisition game device, a claw formed in the claw member may be formed to have a cross-section in the shape that is concave or convex to the lower side in the vertical direction in a state that the claw can grip the prize. In such a case, edges of the claw on both sides can be brought into contact with the bottom face of the prize, and thus, a contact area between the top face of the claw and the prize decreases. In addition, in such a case, the prize easily slides in the direction for opening or closing the arm along the edges of the claw on both sides. As a result, the above-described claw may be effectively used as means for increasing the degree of difficulty of prize acquisition.

According to a fourth aspect of the present invention, there is provided a prize acquisition game device including: a grip part that is moved in a predetermined space in response to an external operation; an arm that is attached to the grip part to be able to be opened or closed and performs an operation for gripping the prize as a target for acquisition or separating the gripped prize; a claw member that is attached to an end portion of the arm to be able to turn; and claw angle adjusting means that is configured to change an angle of the claw member with respect to the arm. The claw angle adjusting means is configured to be able to move a slider disposed in the arm along the arm between a restricted position for a restricted state in which a relative angle of the claw member with respect to the arm is fixed by restricting a turning operation of the claw member relative to the arm and a non-restricted position for a non-restricted state in which the relative angle is allowed to be changed by allowing the turning operation of the claw member. In addition, the claw angle adjusting means is configured to change the angle of the claw member with respect to the arm as a protrusion part of the claw member is fitted in a hole portion by moving the slider from the restricted position to the non-restricted position, then, turning the claw member that is in the non-restricted state from the restricted state relative to the arm such that the protrusion part of the claw member is fitted in any one hole portion selected from a plurality of hole portions disposed in a part of the slider, and moving the slider from the non-restricted position to the restricted position.

According to a fifth aspect of the present invention, there is provided a prize acquisition game device including: a grip part that is moved in a predetermined space in response to an external operation; an arm that is attached to the grip part to be able to be opened or closed and performs an operation for gripping the prize as a target for acquisition or separating the gripped prize; a claw member that is attached to an end portion of the arm to be able to turn; and claw angle adjusting means that is configured to change an angle of the claw member with respect to the arm. The claw angle adjusting means is configured to be able to move a slider disposed in the arm along the arm between a restricted position for a restricted state in which a relative angle of the claw member with respect to the arm is fixed by restricting a turning operation of the claw member relative to the arm and a non-restricted position for a non-restricted state in which the relative angle is allowed to be changed by allowing the turning operation of the claw member. In addition, the claw angle adjusting means is configured to change the angle of the claw member with respect to the arm as one hole portion is engaged with a protrusion part by moving the slider from the restricted position to the non-restricted position, then, turning the claw member that is in the non-restricted state from the restricted state relative to the arm such that any one hole portion selected from among a plurality of hole portions disposed in the claw member is engaged with the protrusion part disposed in a part of the slider, and moving the slider from the non-restricted position to the restricted position.

According to the present invention, angle adjustment of a claw member in an end portion of a gripping arm can be performed simply and assuredly.

BRIEF DESCRIPTION OF THE DRAWINGS

FIG. 15 is a front view showing the appearance in a case where a claw angle is adjusted by turning a claw member.

FIG. 16 is a diagram showing the movement of a slide for claw angle adjustment.

DESCRIPTION OF REFERENCE NUMERALS AND SYMBOLS

Figure 1:
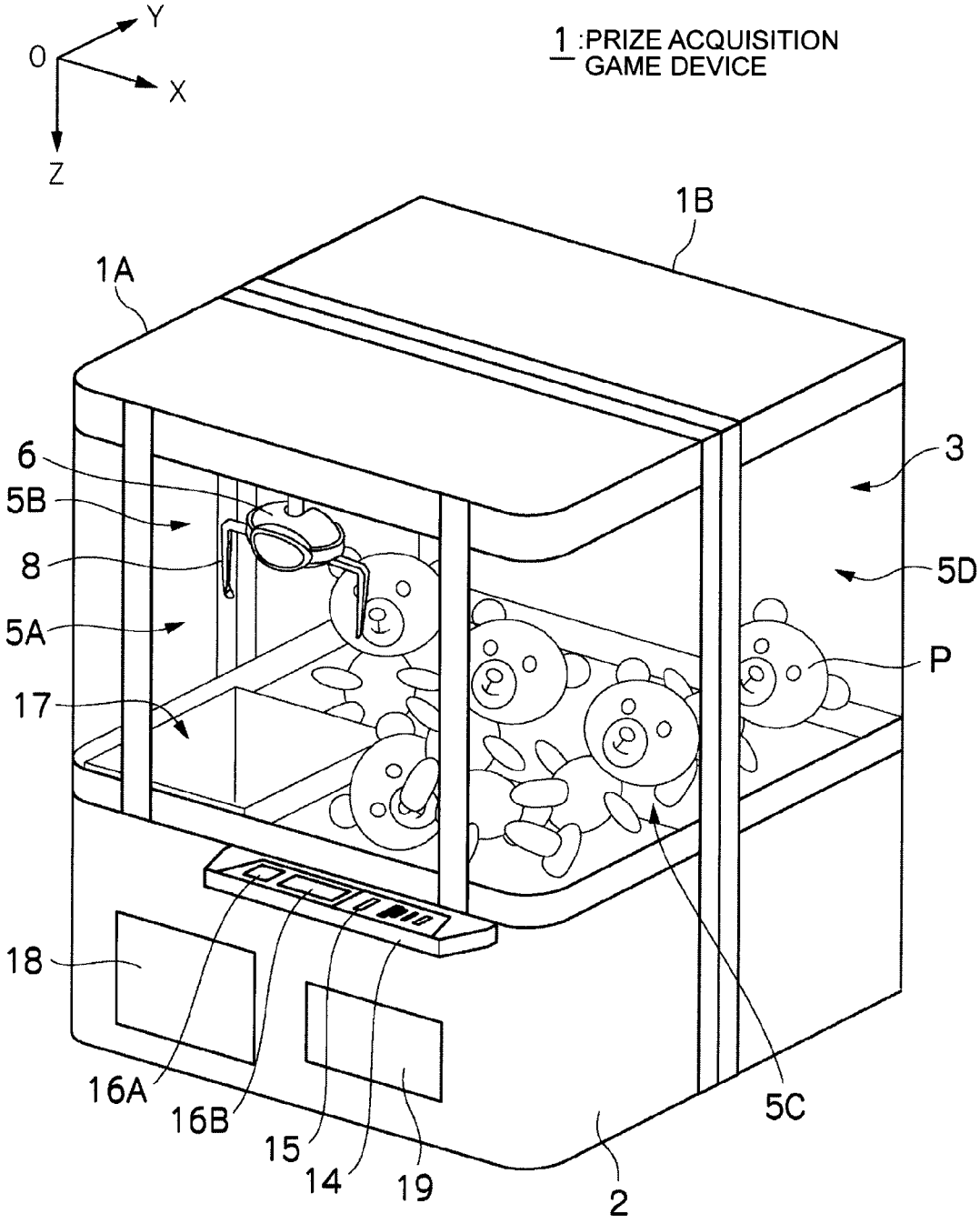
FIG. 1 is a perspective view showing the external configuration of a prize acquisition game device.

1: PRIZE ACQUISITION GAME DEVICE
1A: FRONT CASING
1B: REAR CASING
2: BASE PEDESTAL
3: HOUSING PART
4: CLAW MEMBER
6: GRIP PART
7: MOVEMENT PART
8: ARM
8*a*: FULCRUM POINT
9A-9C: X-DIRECTION MOVEMENT FIXED RAIL
10: Y-DIRECTION MOVEMENT FIXED RAIL
11: PRIZE ACQUISITION BASE PEDESTAL
12: SUPPORT PART
13X-13Z: MOTOR
14: CONTROL PANEL
15: COIN INSERTION SLOT
16A, 16B: FIRST AND SECOND OPERATION BUTTONS
17: PRIZE INSERTION GUIDE
18: TAKE-OUT OPENING
19: GATE
20B, 20C: ROLLER ATTACHMENT PORTION
21B, 21C: ROLLER
22B, 22C: ROLLER FIXING PORTION
23B, 23D: SCREW
24B-24D: LONG HOLE
25B, 25D: NUT
30: CONTROL UNIT
31: MEMORY UNIT
32: TIMER
33: LIMIT SWITCH
34: GRIP PART MOVEMENT DETECTING SWITCH
41: CLAW
41*a*: CONCAVE GROOVE (RESISTANCE REDUCING PORTION)
42: CLAW ANGLE ADJUSTING MEANS
43: SLIDER
43*a*: ENGAGEMENT PART OF SLIDER 43
43*a*': ENGAGING HOLE (HOLE PORTION)
43*b*: GROOVE PORTION
43*c*: GROOVE PORTION
43*d*: HOLDING GROOVE
43*e*: STAIR PART
43*f*: BRIDGE PART
44: STAIR PART
44': PROTRUSION PART
44*a*: ENGAGING GROOVE
45: BIASING MEMBER
46: PIN
47: GUIDE GROOVE
48: THROUGH-HOLE
P: PRIZE

DETAILED DESCRIPTION OF PREFERRED EMBODIMENT

Hereinafter, the configuration of the present invention will be described in detail based on embodiments of the present invention represented in the accompanying drawings.

FIGS. 1 to 14 represent an embodiment of the present invention. A prize acquisition game device 1 according to an embodiment of the present invention includes a grip part 6 that is moved within a predetermined space in accordance with an external operation, an arm 8 that is attached to the grip part 6 to be opened or closed and performs an operation for gripping a prize P as a target to be acquired or separating the gripped prize P, and a claw member 4 that is attached to an end portion of the arm 8. The prize acquisition device 1 is a game device capable of performing a game for gripping and acquiring the prize P. In this embodiment, the claw member 4 is configured to be able to turn relative to the arm 8 in the direction for opening or closing the arm 8. In addition, in the prize acquisition game device 1, claw angle adjusting means 42 that can be switched between a restricted state in which a turning operation of the claw member 4 relative to the arm 8 is restricted and a non-restricted state in which a turning operation of the claw member 4 relative to the arm 8 is allowed by a user's manual operation is additionally provided.

Hereinafter, first, the overall configuration of the prize acquisition game device 1 according to this embodiment will be described. Thereafter, the configuration of the claw member 4 that is disposed in the end portion of the arm 8, the claw angle adjusting means 42 that is used for adjusting a relative angle of the claw 41, and the like will be described in detail. Then, the internal configuration of the prize acquisition game device 1 will be described.

(1) Overall Configuration of Prize Acquisition Game Device 1

The prize acquisition game device according to this embodiment which is represented by reference sign 1 as a whole in FIG. 1 is configured by combining a front casing 1A and a rear casing 1B, as described below. The prize acquisition game device 1 configured by combining the front casing 1A and the rear casing 1B has a structure in which a box-shaped housing part 3 for housing a prize P is disposed on a base pedestal 2 having a rectangular parallel piped shape (see FIG. 1).

The housing part 3 has a front face 5A and side faces 5B and 5C formed of plate-shaped members made of a transparent resin or glass, so that a player can see the prize P housed therein (see FIG. 1). In addition, a rear face 5D of the housing part 3 is formed of a plate-shaped member having a mirror face shape or a plate-shaped member having decoration on its inner face. The front face 5A of the housing part 3 is configured to be able to be opened or closed, for example, by using a structure of a sliding door or a left-right gatefold door. For example, a service provider (in descriptions here, a personnel of a service provider side including a shop assistance of a game center is referred to as a user, differentiated from a player as a gamer) who uses the prize acquisition game device 1 can house the prize P such as a stuffed toy including a character or a miscellaneous good inside the housing part 3 from the front face 5A, extract the prize P from the housing part 3, and change the display state (a state such as disposition or inclination can be appropriately changed) thereof.

Figure 2:
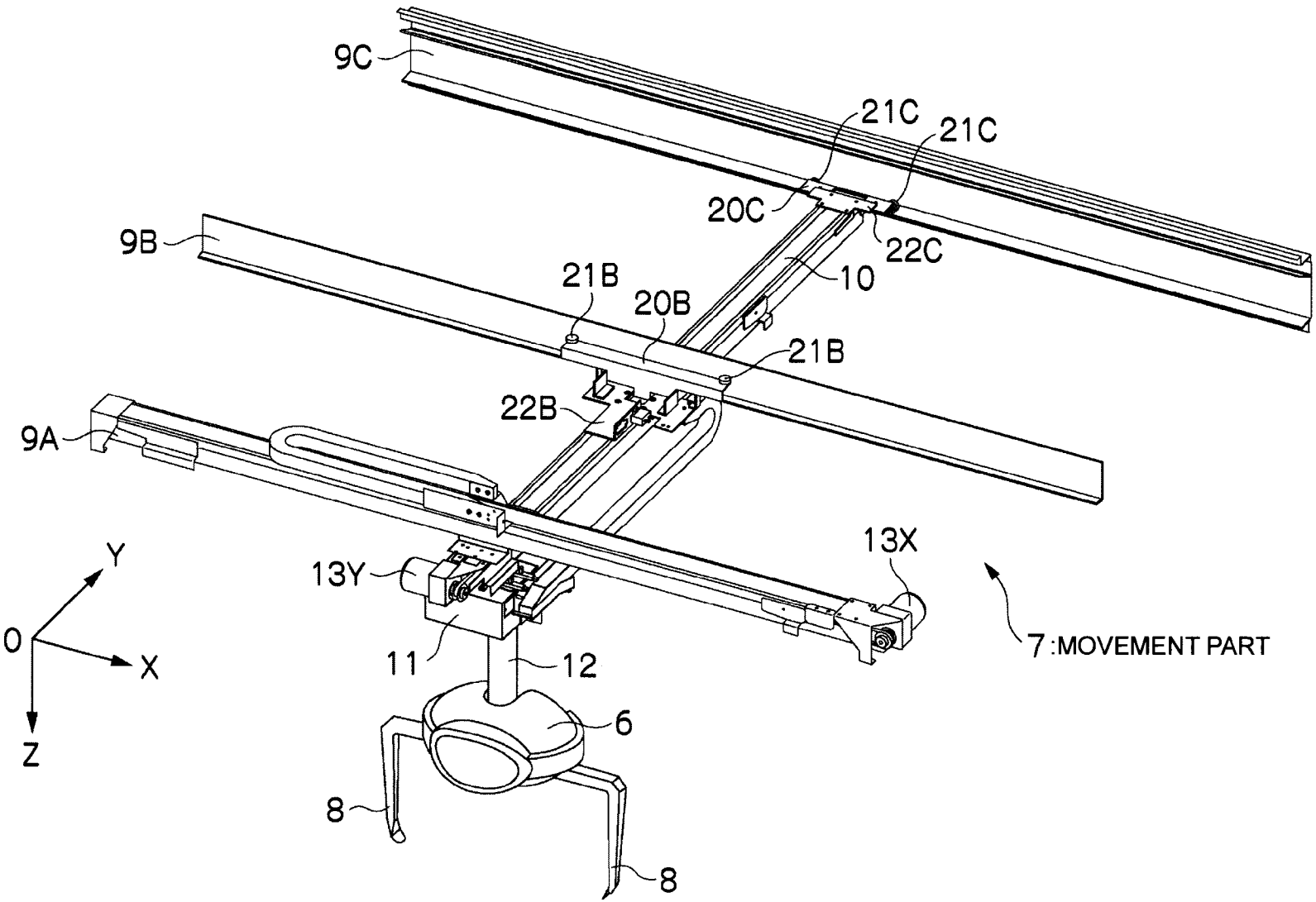
FIG. 2 is a perspective view showing the configuration of a movement part.

In addition, inside the housing part 3, the grip part 6 that is used for gripping the prize P and a movement part 7 that is used for moving the grip part in accordance with an operation of a player are disposed (see FIG. 2 and the like). Among these, the grip part 6, for example, has a pair of arms 8 that are driven to be opened or closed based on the rotation output of a motor (not shown) disposed therein. The grip part 6 is configured to grip the prize P by opening and closing the arms 8. To the end of each arm 8, the claw member 4 is attached. The grip part 6 is configured to be moved inside the housing part 3 by an operation of the movement part 7.

The movement part 7 has a structure in which three fixed rails including first to third X-direction movement fixed rails 9A to 9C that are fixedly disposed to be parallel to the horizontal direction (a direction for connecting the side face 5B and the side face 5C, and hereinafter is referred to as direction X) on the upper side of the housing part 3, a Y-direction movement movable rail 10 that is attached to the first to third X-direction movement fixed rails 9A and 9C to be slidable and parallel to the vertical direction (a direction for connecting the front face 5A and the rear face 5D, and hereinafter is referred to as direction Y), a prize acquisition base pedestal 11 that is attached to the Y-direction movement movable rail 10 to be slidable, and a support part 12 that is attached to the lower side of the prize acquisition base pedestal 11 in the vertical direction (hereinafter, referred to as direction Z) and has retractility are included (see FIG. 2 and the like). The above-described grip part 6 is attached to the lower end portion of the support part 12.

The Y-direction movement movable rail 10 is configured to be movable in the horizontal direction (direction X) along the first to third X-direction movement fixed rails 9A to 9C based on the rotation output of an X-direction movement motor 13X. The prize acquisition base pedestal 11 is configured to be movable in the vertical direction (direction Y) along the Y-direction movement movable rail 10 based on the rotation output of a Y-direction movement motor 13Y. In addition, the support part 12 is configured to be retractable based on the rotation output of a Z-direction movement motor 13Z (see FIG. 4). In the prize acquisition game device 1 according to this embodiment, the grip part 6 can be moved to a desired position inside the housing part 3 by appropriately operating the X-direction movement motor 13X, the Y-direction movement motor 13Y, and the Z-direction movement motor 13Z that have the above-described configurations.

On the front side of the base pedestal 2, a control panel 14 that is an operation desk is disposed (see FIG. 1). In the control panel 14, an operation unit 16 configured by a coin insertion slot 15 that is used for inserting a coin for playing a game, a first operation switch 16A that is used for the player to input an operation for moving the grip part 6 to a desired position in the direction X in a game, and a second operation switch 16B that is used for the player to input an operation for moving the grip part 6 to a desired position in the direction Y thereafter are disposed. The operation unit 16 may be configured by other operation means such as s joystick.

In addition, on the front side of the base pedestal 2, a take-out opening 18 for a prize which is communicated with a tube-shaped prize insertion guide 17 disposed in a predetermined position inside the housing part 3 is disposed (see FIG. 1). To be described later in detail, a prize P that has been gripped by the grip part 6, transported, and dropped inside the prize insertion guide 17 can be taken out from the take-out opening 18. In addition, on the front side of the base pedestal 2, an additional gate 19 is disposed. On the inner side of the opened gate 19, a main board (not shown) including a control unit 30 (see FIG. 4) that controls the whole prize acquisition game device 1 and the like is housed.

Figure 3:
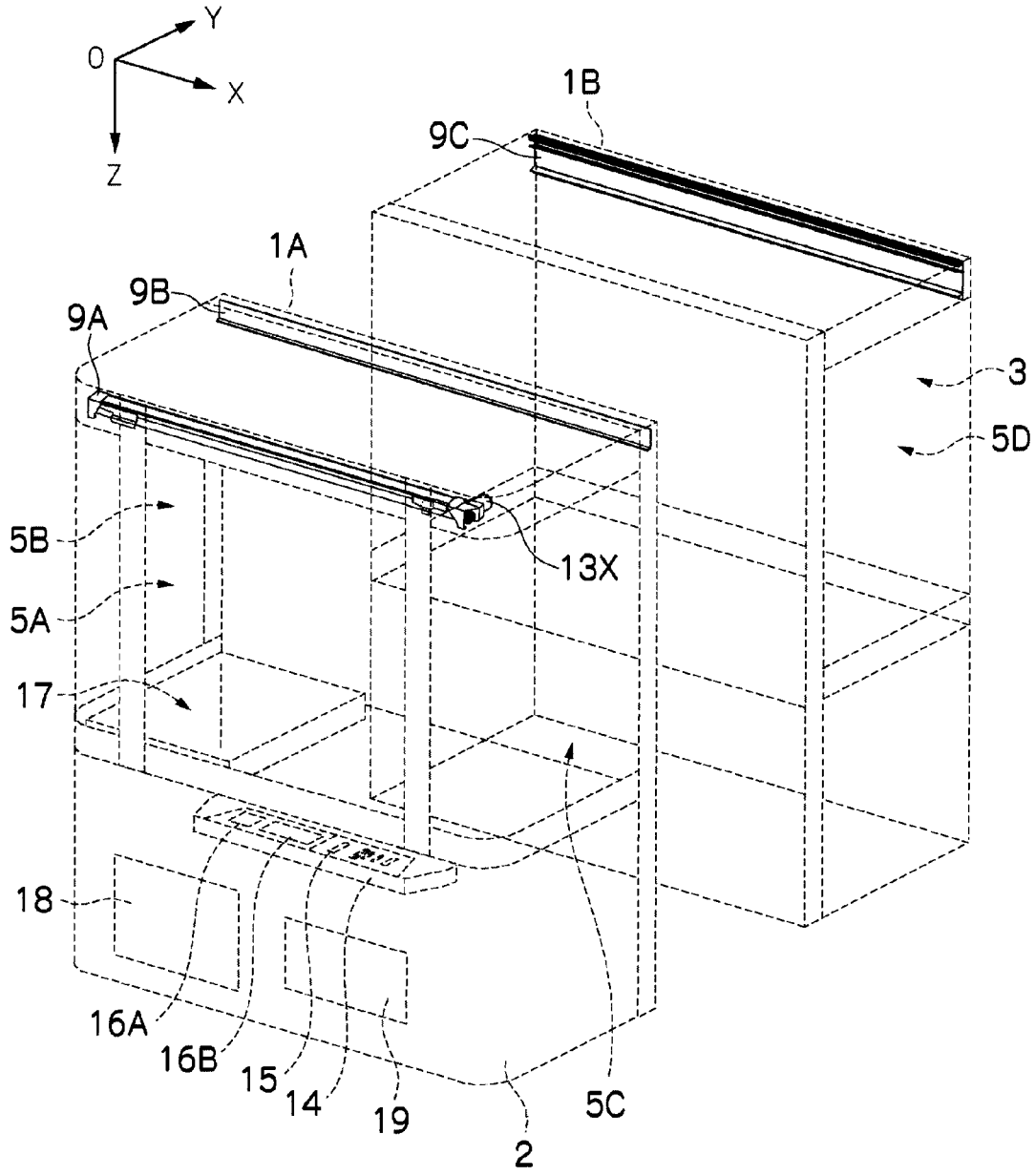
FIG. 3 is a perspective view showing the configuration of an X-direction movement fixed rail.

In the prize acquisition game device 1 according to this embodiment, the first X-direction movement fixed rail 9A that is configured together with a belt (not shown) that is used for driving the X-direction movement motor 13X and the Y-direction movement movable rail 9 is, for example, disposed to be fixed by a screw in the front casing 1A (see FIG. 3). In the prize acquisition game device 1, the second X-direction movement fixed rail 9B is configured as a frame of the front casing 1A. In addition, in the prize acquisition game device 1, the third X-direction movement fixed rail 9C is configured as a frame of the rear casing 1B. In the prize acquisition game device 1, the Y-direction movement movable rail 10 is configured to extend over the front casing 1A and the rear casing 1B.

In addition, in the prize acquisition game device 1 according to this embodiment, a roller (not shown) attached to a roller attachment portion (not shown) is disposed in the end portion of the Y-direction movement movable rail 10 on the origin side. Similarly, a roller 21B attached to a roller attachment portion 20B is disposed in an approximate center of the Y-direction movement movable rail 10, and a roller 21C attached to a roller attachment portion 20C is disposed in the end portion of the Y-direction movement movable rail 10 in direction Y (see FIG. 2).

The origin described here is a position of which coordinates in directions X, Y, and Z are zero. For example, for the prize acquisition game device 1 according to this embodiment, the origin becomes the initial position of the grip part 6, that is, a default position of the grip part 6 at the start of a game and the end of a game or a position in the vicinity thereof (see FIG. 1 and the like). The initial position of the grip part 6 in this embodiment is a position located on the right upper side of the prize insertion guide 17.

(2) Configuration of Claw Member, Claw Angle Adjusting Means, etc.

Subsequently, hereinafter, the configurations of the claw member 4 disposed in the end portion of the arm 8, the claw angle adjusting means 42 used for adjusting a relative angle of the claw 41, and the like will be described in detail (See FIGS. 7 to 16).

The claw member 4 is attached to the end portion of the arm 8 to be able to turn in the direction for opening or closing the arm 8. For example, in this embodiment, the claw member 4 is pin-connected to a fulcrum point 8*a* located in the end portion of the arm 8 by a pin 46 inserted into a through-hole 48 (see FIG. 9), and is in a state that the claw member 4 can be turned in the direction for opening or closing the arm 8 (see FIG. 7). Here, when one pair of arms 8 is provided as described above, the direction for opening or closing the arm 8 is a direction in a case where arms 8 forming the one pair approach each other or are spaced apart from each other (see FIG. 2 and the like).

In addition, the claw member 4 is configured to have the claw 41 and the claw angle adjusting means 42. Between these, the claw 41 is a part to be inserted between piled prizes P or to be used for hooking and lifting a part of a prize P or loading a prize P in a game for acquiring a prize P. The shape, size, inclination, and the like of the claw 41 can be important factors that determine the degree of difficulty of prize acquisition in an actual device. Although the claw 41 according to this embodiment is fixed to the claw member 4, the claw may be attached to the claw member in a detachable or replaceable state, for example, by screw fixing or installing (see FIG. 7 and the like).

The claw angle adjusting means 42 is configured to be switchable between a restricted state in which the turning operation of the claw member 4 relative to the arm 8 is restricted and a non-restricted state in which the turning operation of the claw member 4 relative to the arm 8 is allowed, by a user's manual operation. A concrete configuration of the above-described claw angle adjusting means 42 is not particularly limited. As an example, in this embodiment, the claw angle adjusting means 42 is configured by using a slider 43 that can be moved between a restricted position in which the turning operation of the claw member 4 is restricted and a non-restricted position in which the turning operation of the claw member 4 is allowed (see FIGS. 7 to 11).

Figure 7:
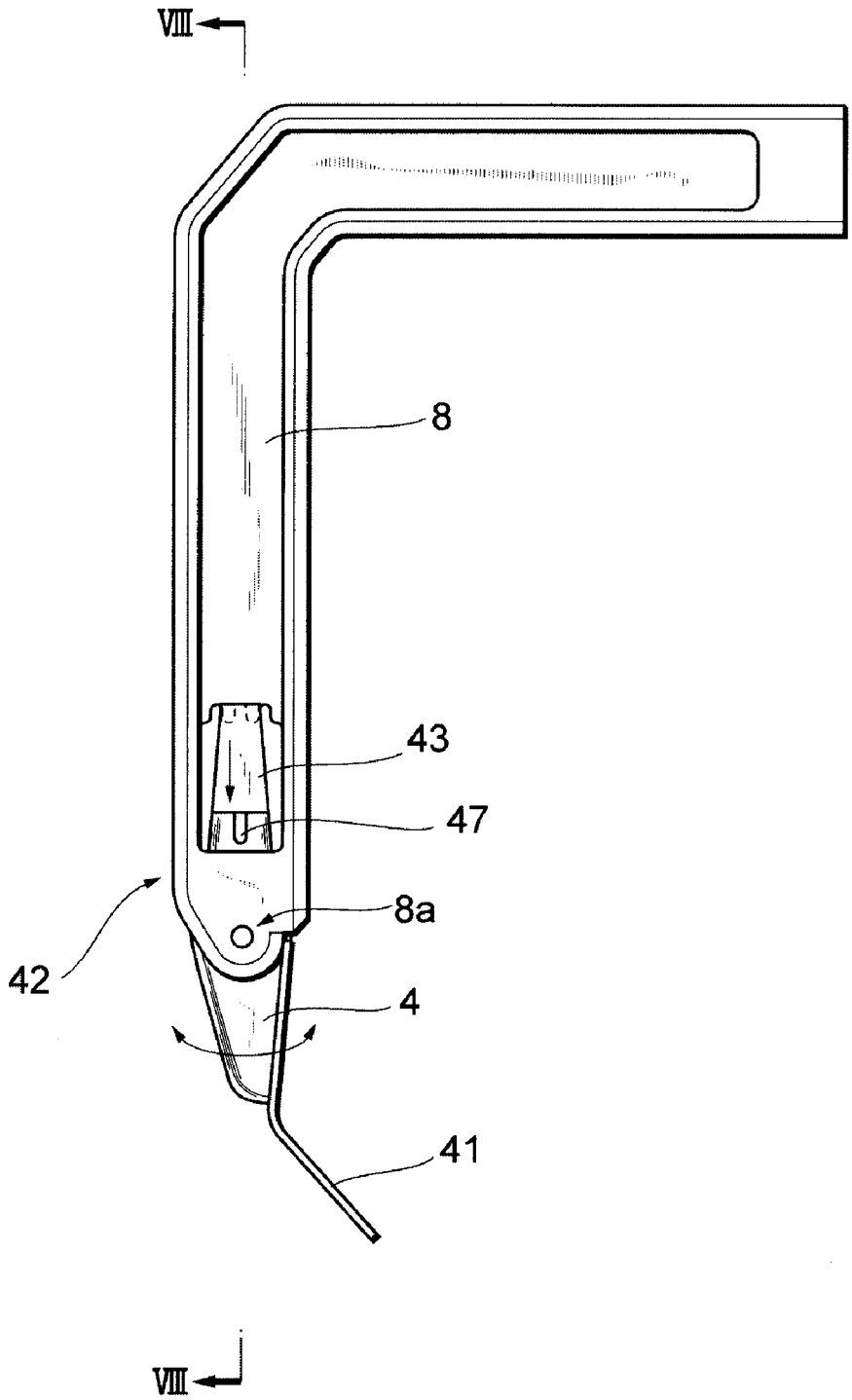
FIG. 7 is a front view showing the configuration of a claw member and claw angle adjusting means according to an embodiment.

For example, the slider 43 according to this embodiment is disposed to be movable above the claw member 4 in the longitudinal direction of the arm 8 (see FIG. 7 and the like). Described in more details, in a base end (on a side opposite to the claw 41) of the claw member 4, a guide groove 47 for guiding the slider 43 is disposed (see FIG. 9), and the slider 43 is configured to be movable along the guide groove 47 with a part thereof guided.

Figure 9:
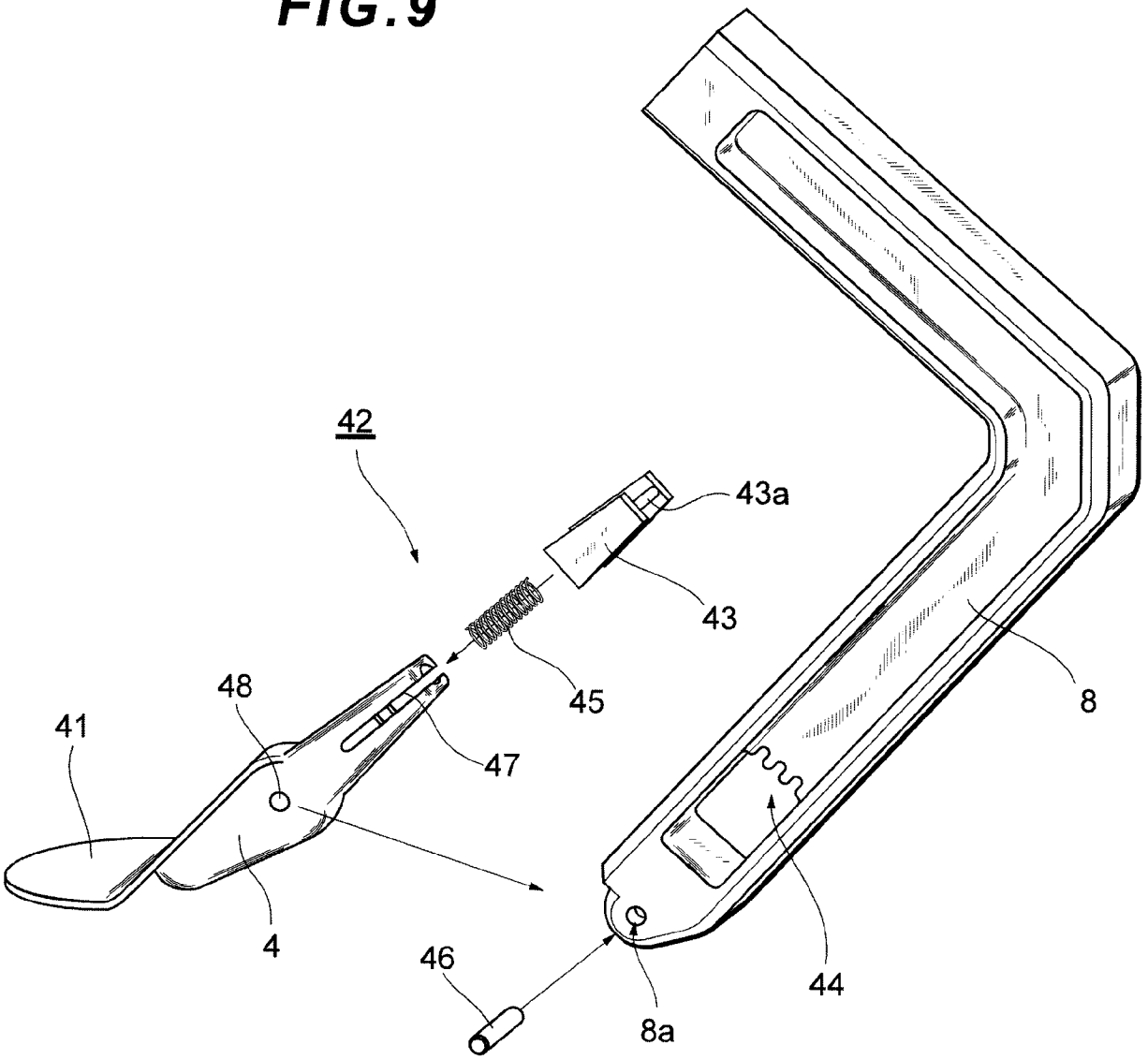
FIG. 9 is an exploded perspective view of the claw angle adjusting means.
Figure 10:
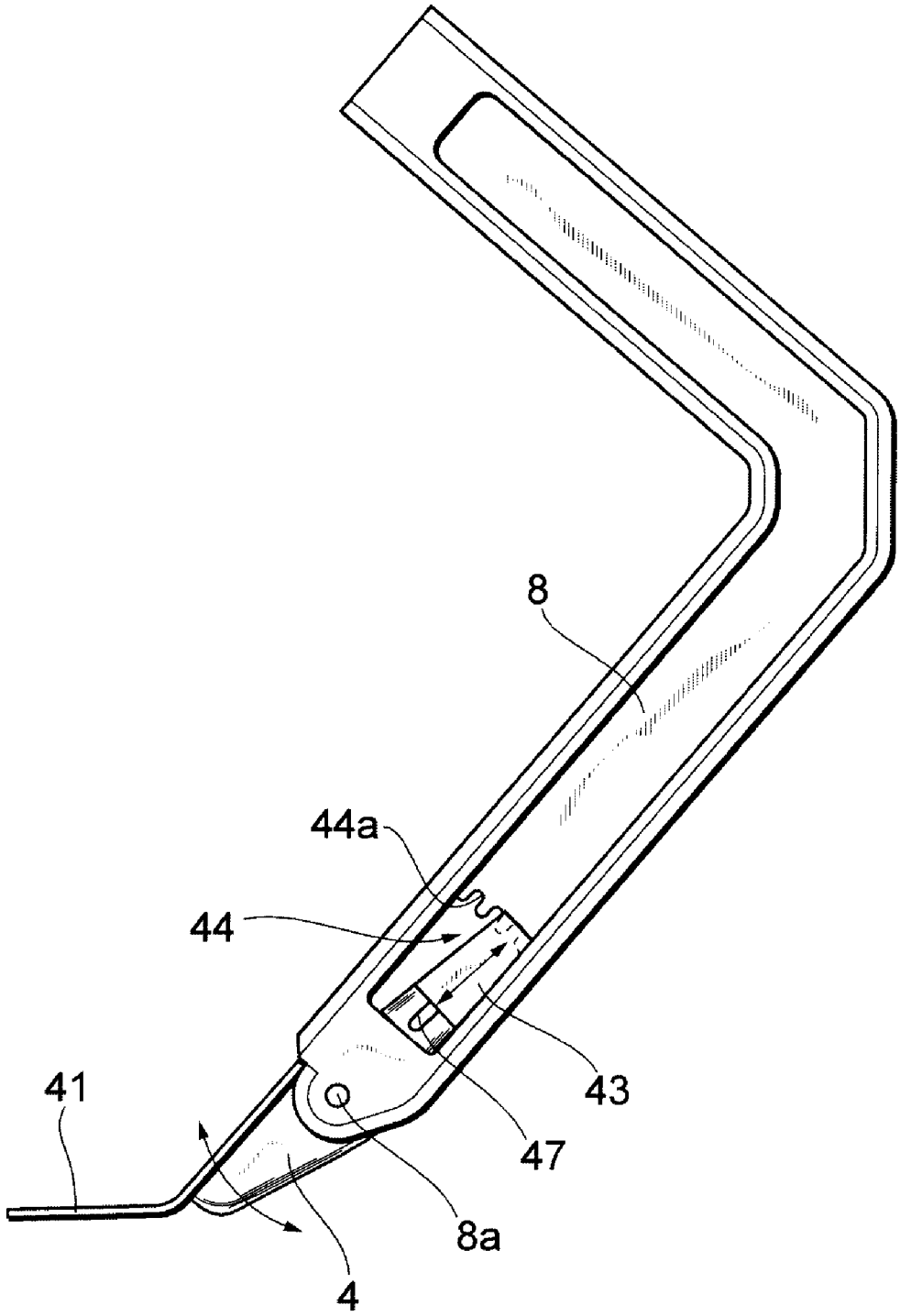
FIG. 10 is another diagram showing the configuration of a claw member and claw angle adjusting means.

In addition, for example, on the base end side of the slider 43, an engagement part 43*a* is disposed, and a stair part 44 having multiple steps is disposed in the arm 8 for engaging the engagement part 43*a* (see FIG. 9 and the like). The stair part 44 is used for switching the claw angle adjusting means 42 to the restricted state by forming an engaged state of the engagement part 43*a* that is a part of the slider 43. For example, in this embodiment, the stair part 44 is formed by three engaging grooves 44*a* that are disposed in the turning direction of the claw member 4 (see FIG. 9). The engagement part 43*a* of the slider 43 is, for example, formed by a pin or the like that has the size fitting in the engaging grooves 44*a*.

Figure 11:
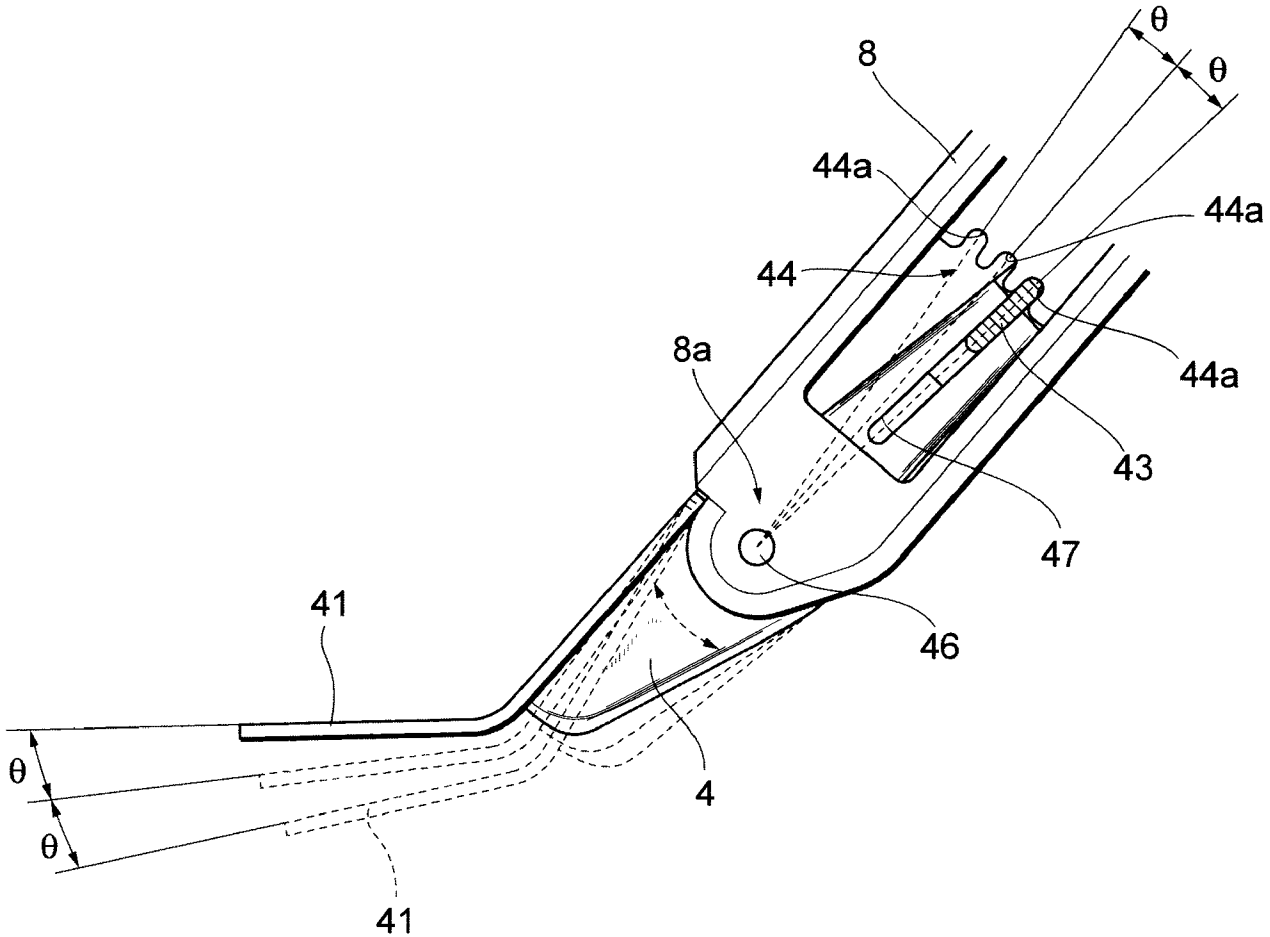
FIG. 11 is an enlarged diagram of a portion enclosed by a circle shown in FIG. 10 and shows a cross-section of a slider.

The plurality of the engaging grooves 44*a* according to this embodiment is disposed at approximate regular intervals in the turning direction of the claw member 4 (see FIG. 11 and the like). Thus, by using this claw angle adjusting means 42, a relative angle of the claw member 4 (and the claw 41) with respect to the arm 8 can be changed by a predetermined angle θ every time the engaging groove 44*a* with which the engagement part 43*a* of the slider 43 is engaged is deviated by one step. Accordingly, for example, it is convenient to perform angle adjustment of a total of 10° as two steps each for angle adjustment of 5°.

Although not particularly drawn in this embodiment, each engaging groove 44*a* that forms the stair part 44 may be configured to have a width slightly smaller than the engagement part 43*a* of the slider 43 with which the each engaging groove 44*a* is engaged. In such a case, since the engagement part 43*a* that is engaged in the engaging groove 44*a* is in a state that the engagement part 43 is not easily disengaged from the engaging groove 44*a*, the state in which a turning operation of the claw member 4 is restricted can be maintained in an easy manner unless a user (for example, a service provider side such as a game center or a store) performs an operation for the engagement part 43*a*. The user can insert the engagement part 43*a* into the engaging groove 44*a* by pushing the slider more strongly than usual. On the other hand, the user can take out the engagement part 43*a* from the engaging groove 44*a* by pulling the slider 43 more strongly than usual.

The claw angle adjusting means 42 according to this embodiment is configured to include a biasing member 45 that biases the slider 43 to the restricted position side (see FIG. 9). Under such a configuration, the biasing member 45 continuously biases the slider 43 to the restricted position except for a case where claw angle adjustment is performed (for example, during a game or the like), and thereby deviation of the slider 43 to the non-restricted position side is suppressed. In addition, in order to perform claw angle adjustment, the slider 43 is moved against the biasing force. Accordingly, the angle adjustment can be performed by a simple operation. A concrete configuration of the biasing member 45 is not particularly limited. However, for example, in this embodiment, a coil spring that can be housed in a concave portion of the guide groove 47 is used as the biasing member 45 (see FIG. 9 and the like).

Figure 8:
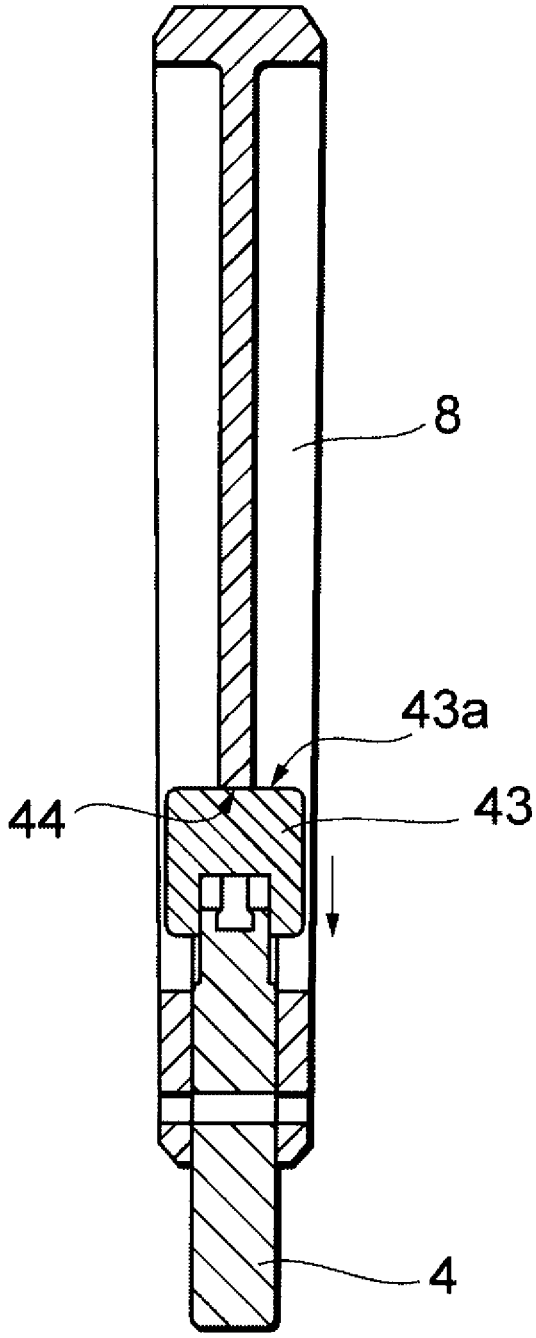
FIG. 8 is a cross-section view of FIG. 7 taken along line VIII-VIII.

In this embodiment, the width of the slider 43 in the direction for opening or closing the arm 8 is configured to be smaller than that of the arm 8 (see FIG. 8). When a portion of the slider 43 protrudes from a side part of the arm 8 (in a state that a portion of the slider 43 protrudes), there is a possibility that the protruded portion is caught on a prize P during a prize acquisition game. In view of this problem, in the prize acquisition game device 1 according to this embodiment, as described above, the width of the slider 43 is configured to be smaller than that of the arm 8 and both side parts of the slider 43 are disposed to be located on the inner side from those of the arm 8. In other words, a state similar to a state in which the slider 43 is dropped in a concave portion of the both sides of the arm 8 is formed. Accordingly, the slider 43 is rarely caught on a prize P, and thus there is no influence upon the prize acquisition game.

As described above, according to the prize acquisition game device 1 of this embodiment, the claw member 4 is configured to be able to turn relative to the arm 8, and the claw angle adjusting means 42 that restricts or allows the turning operation of the claw member 4 can be switchable by a manual operation. Accordingly, for example, a user such as a service provider or the like can change the angle of the claw member 4 with respect to the arm 8 in a simple manner without using a tool or the like. In particular, the relative angle of the claw member 4 (and the claw 41) with respect to the arm 8 can be adjusted in a simple manner by manually moving the slider 43 constituting the claw angle adjusting means 42 to be switched to the non-restricted state, changing the relative angle of the claw member 4, and then manually switching the slider 43 back to the restricted state (see FIGS. 15, 16, and the like). For example, in a case where a fastening screw is used as means for fixing the claw member 4 and the claw 41, a series of operations including adjusting the angle by loosening the fastening screw and then fastening the fastening screw again is needed, and a tool such as a driver is needed. However, according to the prize acquisition game device 1 of this embodiment, an operation needed for angle adjustment becomes very simple.

In addition, the claw angle adjusting means 42 is configured to include the stair part 44 having multiple steps, and thus the restricted state can be formed by engaging the engagement part 43*a* of the slider 43 with any one step of the stair part 44. Accordingly, angle adjustment can be performed by a simple operation. In addition, for example, in a case where a fastening screw is used, when the fastening screw is fastened tightly, the claw member 4 may be deviated from a desired angle due to a slip or a discrepancy thereof. However, since a fastening operation is not performed in this embodiment, a slip or a deviation due to the fastening operation does not occur. Thereby, angle adjustment of the claw member 4 can be performed assuredly and simply.

In addition, according to this embodiment, a structure in which the slider 43 is moved above the claw member 4 is used, and accordingly the claw member 4 can be turned by operating the slider 43. Thus, a user (for example, a service provider of a game center, a store, or the like) can perform a movement operation of the slider 43 and the turning operation of the claw member 4 by using one hand while holding the arm 8 by using the other hand, and thereby the operation can be performed in a simple manner. In addition, when the engagement part 43*a* of the slider 43 is engaged with any one stair part 44 (or an engaging groove 44*a* constituting the stair part 44), a predetermined claw angle that is determined by the position of the engagement part 44*a* can be set. Accordingly, precise angle adjustment can be performed in an easy manner (see FIGS. 10, 11, and the like). For example, by deviating the engaging groove 44*a* that is engaged with the slider 43 by two, angle adjustment for the claw 41 that forms an angle of $\alpha$ from the vertical line to an angle of $(\alpha+10)°$ can be easily performed (see FIGS. 15 and 16). As described above, the user can perform the angle adjustment by a simple operation of moving the slider 43 to the non-restricted position, turning the claw member 4 by a desired angle, and returning the slider 43 to the non-restricted position, and thereby an angle adjustment operation can be performed assuredly in a simple manner.

In addition, the above-described slider 43 is configured to be moved along the longitudinal direction of the arm 8. By moving the slider 43 along the longitudinal direction of the arm 8 as described above, there is also an advantage that the claw angle adjusting means 42 having a simple structure can be easily formed with the width and thickness of the arm 8 suppressed.

Subsequently, the shape of the claw 41 disposed in the claw member 4 and the like will be described (see FIG. 12 and the like).

As described above, the shape, size, and inclination and the like of the claw 41 disposed in the claw member 4 are important factors that determine the degree of difficulty of prize acquisition in an actual device. For example, in this embodiment, a plurality of concave grooves 41A having shapes corresponding to the direction for opening or closing the arm 8 is formed in at least a part of the claw 41 (see FIG. 12). In such a case, a contact area between the face of the claw 41 on which the concave grooves 41A are formed and the prize P decreases (see FIG. 13). In addition, the grooves are formed in accordance with the direction for opening or closing the arm 8. Thus, slip resistance for a case where the prize P is loaded in the claw 41 decreases, and accordingly, the prize P can easily slip off the surface of the claw 41. Thus, as a claw 41 that is used for increasing the degree of difficulty of acquisition of the prize P, the above-described claw can be used effectively. The concave groove 41A described here is merely an example of a structure for decreasing the slip resistance. Thus, the contact area can be decreased by using a plurality of concave parts aligned discontinuously, or the contact area can be decreased by concave parts formed in an area by forming a plurality of convex parts aligned discontinuously in the other area. In addition, the concave parts can be formed by using a plurality of aligned slits. The main point is that the concave groove 41A described as an example here is merely an example of a structure (a resistance reducing portion) for decreasing the slip resistance by decreasing the contact area between the prize P and the claw 41. From this viewpoint, the resistance reducing portion as described above can be configured by using a structure formed by various shapes such as an undulating part, a wave-shaped part, a non-flat part, a convexo-concave part, and a multiple-step part other than the above-described concave groove.

Figure 12:
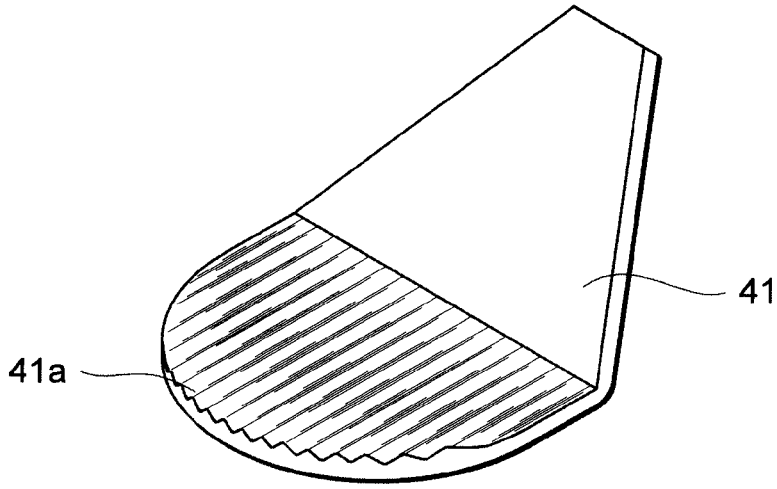
FIG. 12 is a perspective view showing an example of a claw in which a plurality of grooves in the shape along the direction of opening or closing an arm is formed.
Figure 13:
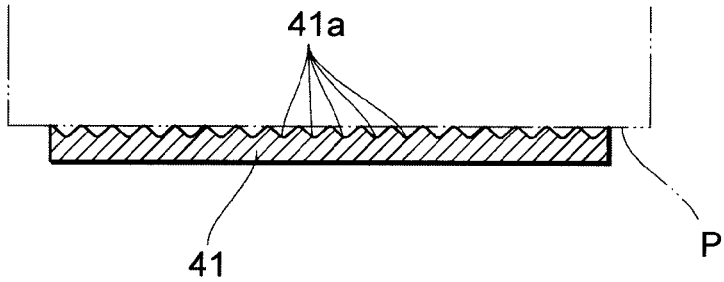
FIG. 13 is a cross-section view of the claw shown in FIG. 12.

In addition, in FIGS. 12 and 13, the concave grooves 41A are formed on the entire face of the claw 41 which faces the upper side for a case where the arm 8 is closed, as an example. However, it is a merely an appropriate example, and the concave grooves 41A may be formed in a part of the face which faces the upper side. The main point is that the shape of the concave grooves 41A is not particularly limited as long as it can decrease the contact area between the prize P and the claw 41 and decrease the slip resistance as described above. In addition, the area and disposition of the concave groove 41A are not particularly limited. In consideration of the labor for processing the claw and versatility of the claw, specific concave grooves 41A may be formed on the whole surface of the claw 14.

Figure 14:
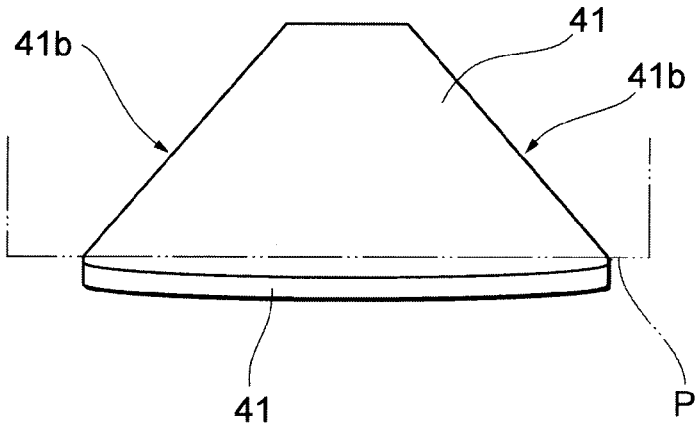
FIG. 14 is a diagram showing an example of a claw formed to have a shape convex to the lower side in the vertical direction.
Figure 15B:
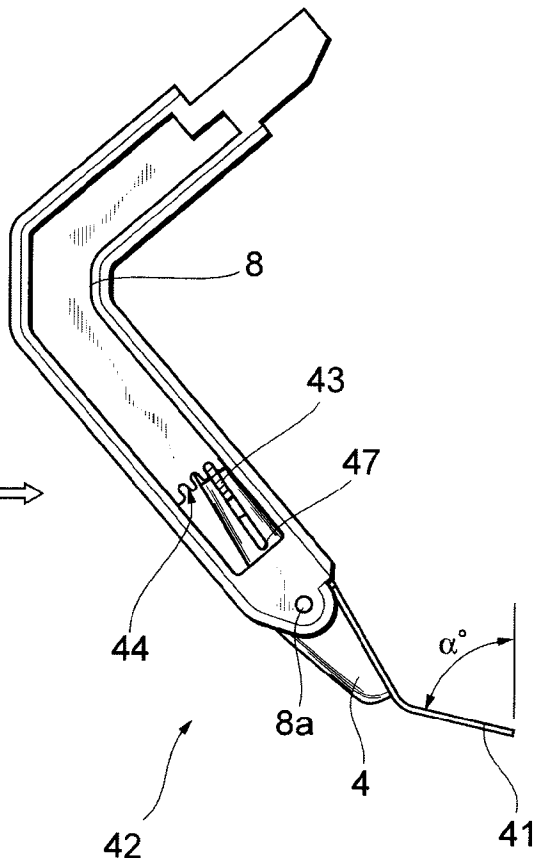
FIG. 15(B) shows a state in which the angle formed by the end part of a claw and the vertical line is $\alpha°$.
Figure 15A:
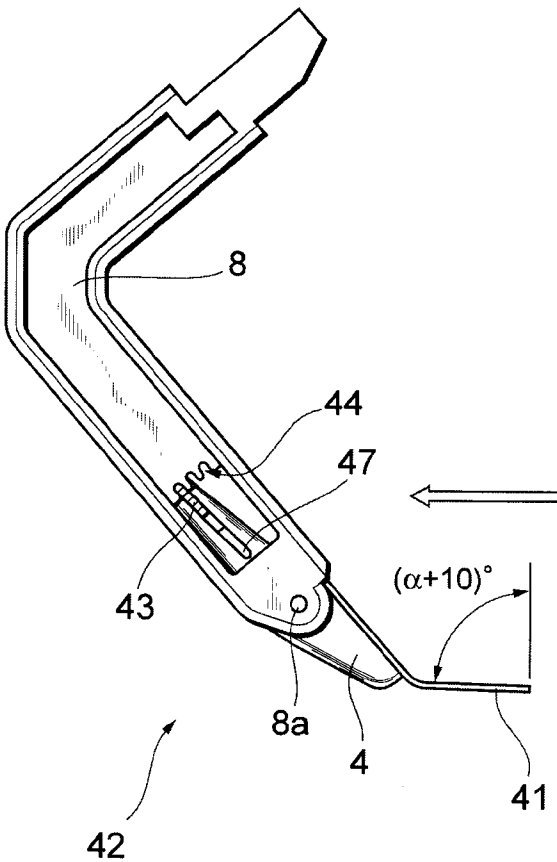
FIG. 15(A) shows a state in which an angle formed by the end part of a claw and a vertical line is $(\alpha+10)°$.
Figure 16B:
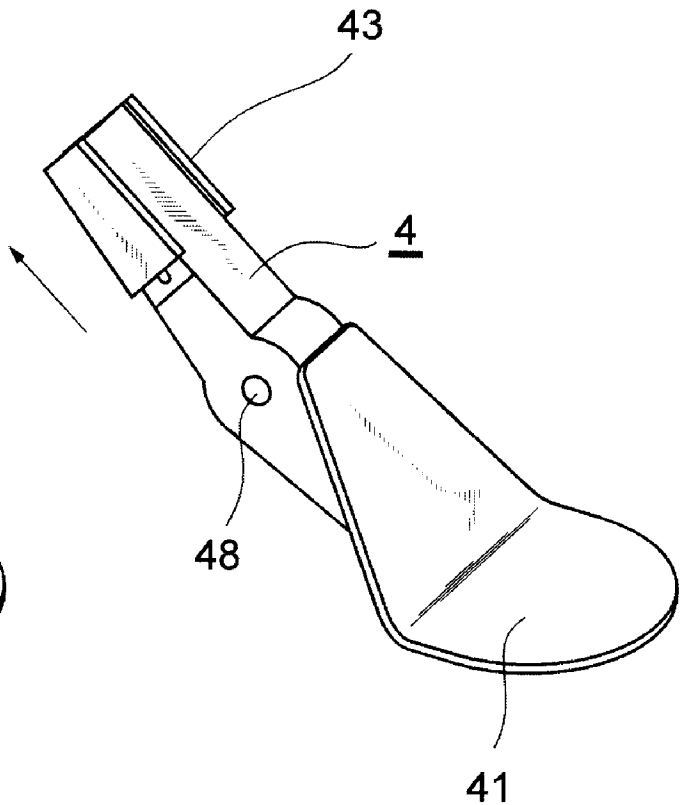
FIG. 16(B) shows a state in which the slider is sled to the claw side.
Figure 16A:
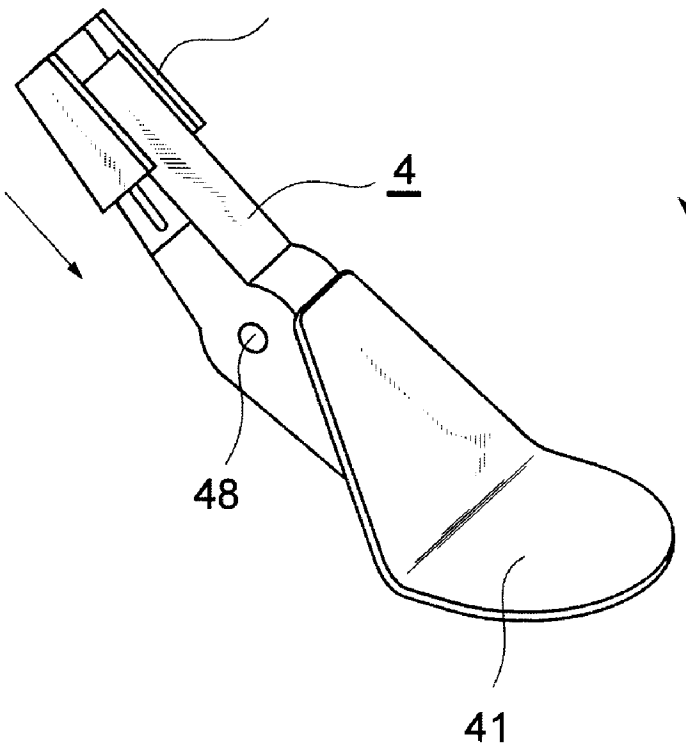
FIG. 16(A) shows a state in which the slider is sled to the end part side.
Figure 17:
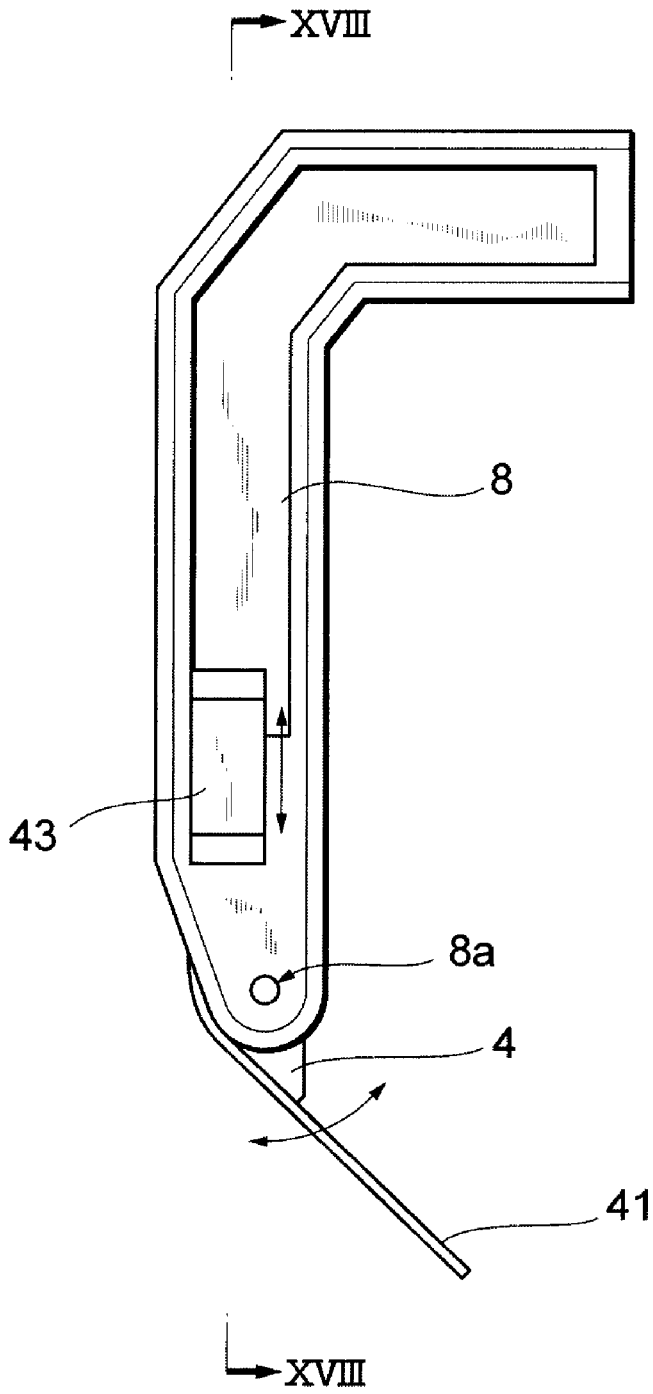
FIG. 17 is a front view showing the configuration of a claw member and claw angle adjusting means according to another embodiment of the present invention.
Figure 18:
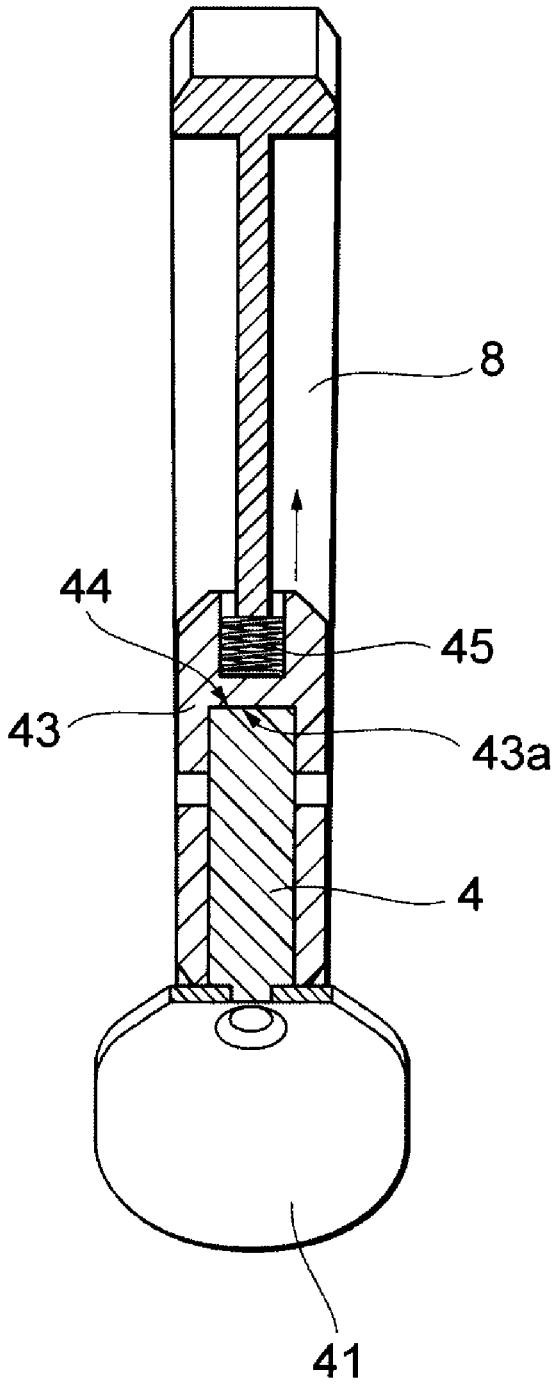
FIG. 18 is a cross-section view of FIG. 17 taken along line XVIII-XVIII.
Figure 19:
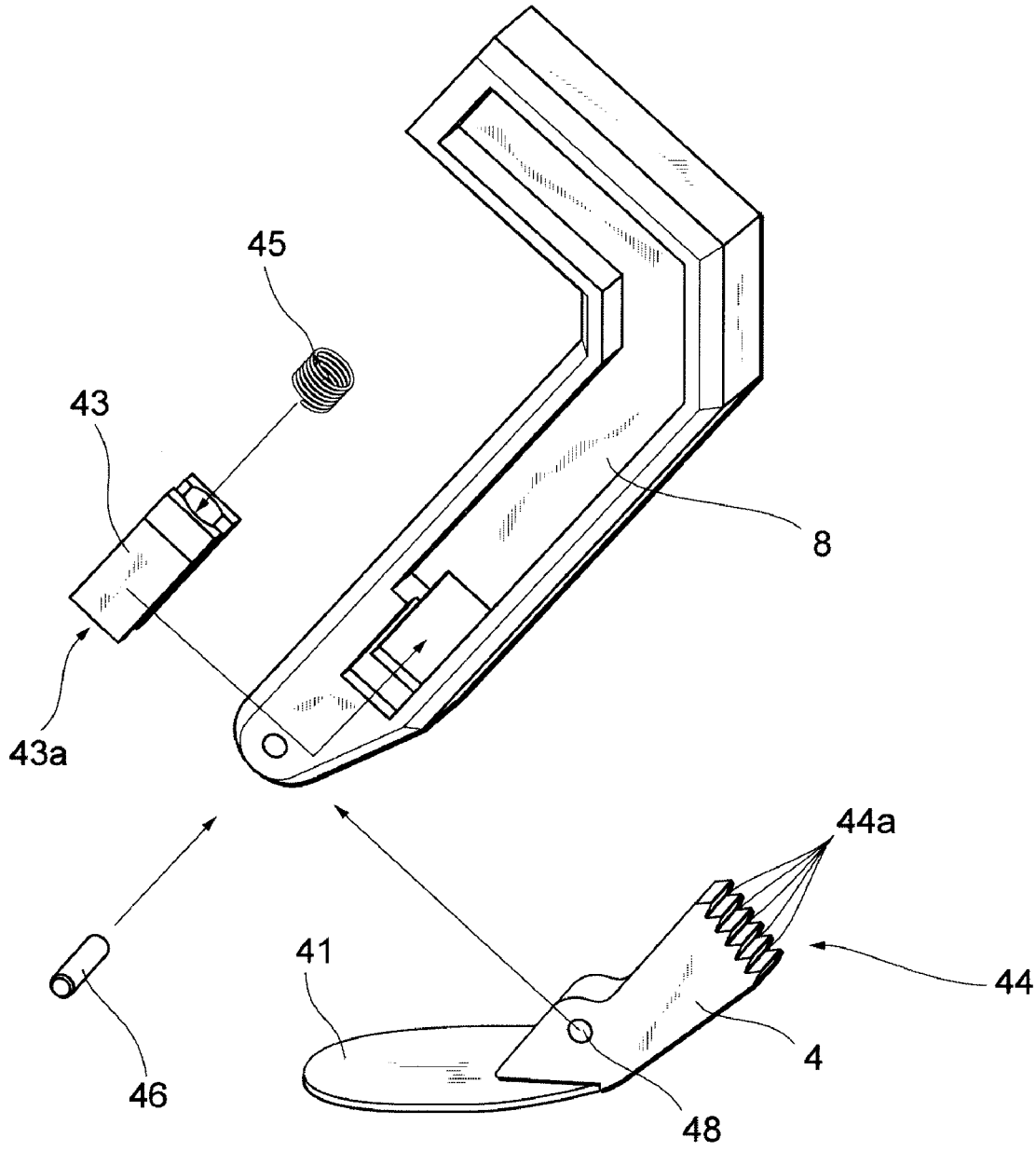
FIG. 19 is an exploded perspective view of claw angle adjusting means according to another embodiment of the present invention.
Figure 20:
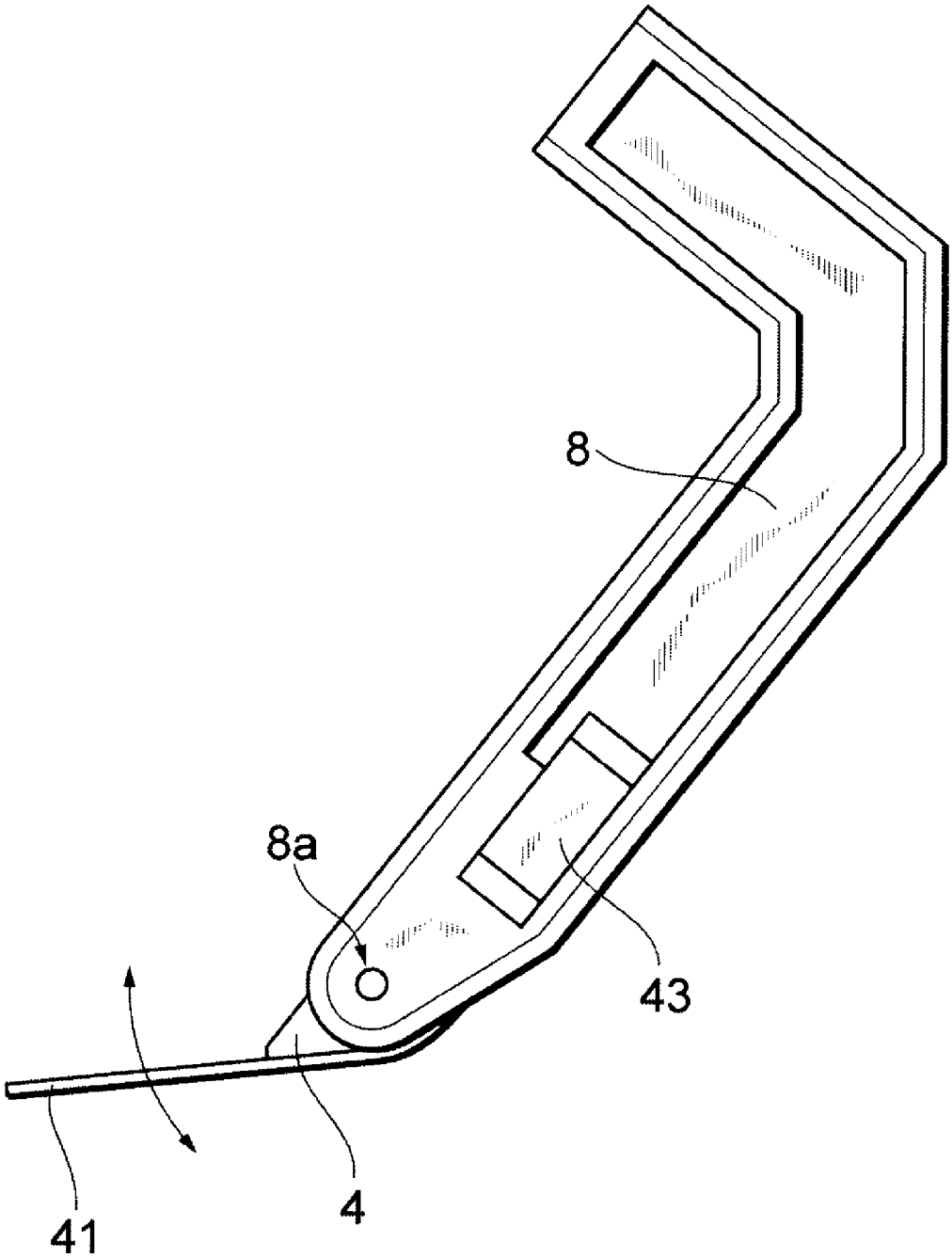
FIG. 20 is another diagram showing the configuration of a claw member and claw angle adjusting means according to another embodiment of the present invention.

In the above-described viewpoint of decreasing the contact area between the claw 41 and the prize P, the claw 41 may be formed in the shape that is convex to the lower side in the vertical direction (see FIG. 14). For example, when the prize P has a box shape of a rectangular parallelepiped, only edges 41B of the claw 41 on both sides are brought into contact with the lower face of the prize P. Accordingly, the contact area between the above-described claw 41 and the prize P is decreased. In addition, the prize P may be easily slipped along the edges 41B of the claw 41 on both sides in the direction for opening or closing the arm 8. Accordingly, as a claw 41 that is used for increasing the degree of difficulty of acquisition of the prize P, the above-described claw 41 may be effectively used.

Here, although a case where the claw 41 is convex to the lower side in the vertical direction has been described (see FIG. 14), on the contrary, the claw 41 may be formed in the shape that is concave to the lower side in the vertical direction (that is, a shape that is convex to the upper side in the vertical direction). For example, when three or four arms 8 and claws 41 are disposed in one grip part 6, a prize P can be gripped by at least three-point support. Accordingly, in such a case as an example, the contact area between the claw 41 having the shape that is concave to the lower side in the vertical direction and the prize P can be decreased without losing functions of the claw 41 and the arm 8.

According to the above-described prize acquisition game device 1 of this embodiment, a game administration service can be effectively performed. In other words, in a game device in which a prize P is acquired by directly catching or hooking the prize P, the degree of difficulty of acquisition of the prize P is needed to be changed in accordance with characteristics and costs of the prize P. Thus, when the degree of difficulty is not appropriately changed in time, there may be no profit due to excessive discharge of the prizes P or guests may leave due to too small discharge of the prizes P. However, in a conventional prize acquisition game device 1, adjustment of the claw angle cannot be made, or even if the adjustment of the claw angle can be made, the adjustment of the claw angle cannot be performed simply and easily by using a fastening screw that is used in the conventional prize acquisition game device 1. Accordingly, setting the degree of difficulty cannot be adjusted in a simple manner. In view of this problem, in the prize acquisition game device 1 according to this embodiment, the adjustment of the angle of the claw member 4 in the end portion of the gripping arm 8 can be performed simply and assuredly with profitability and the like considered, and accordingly, the game administration service thereof can be performed more efficiently.

Figure 22:
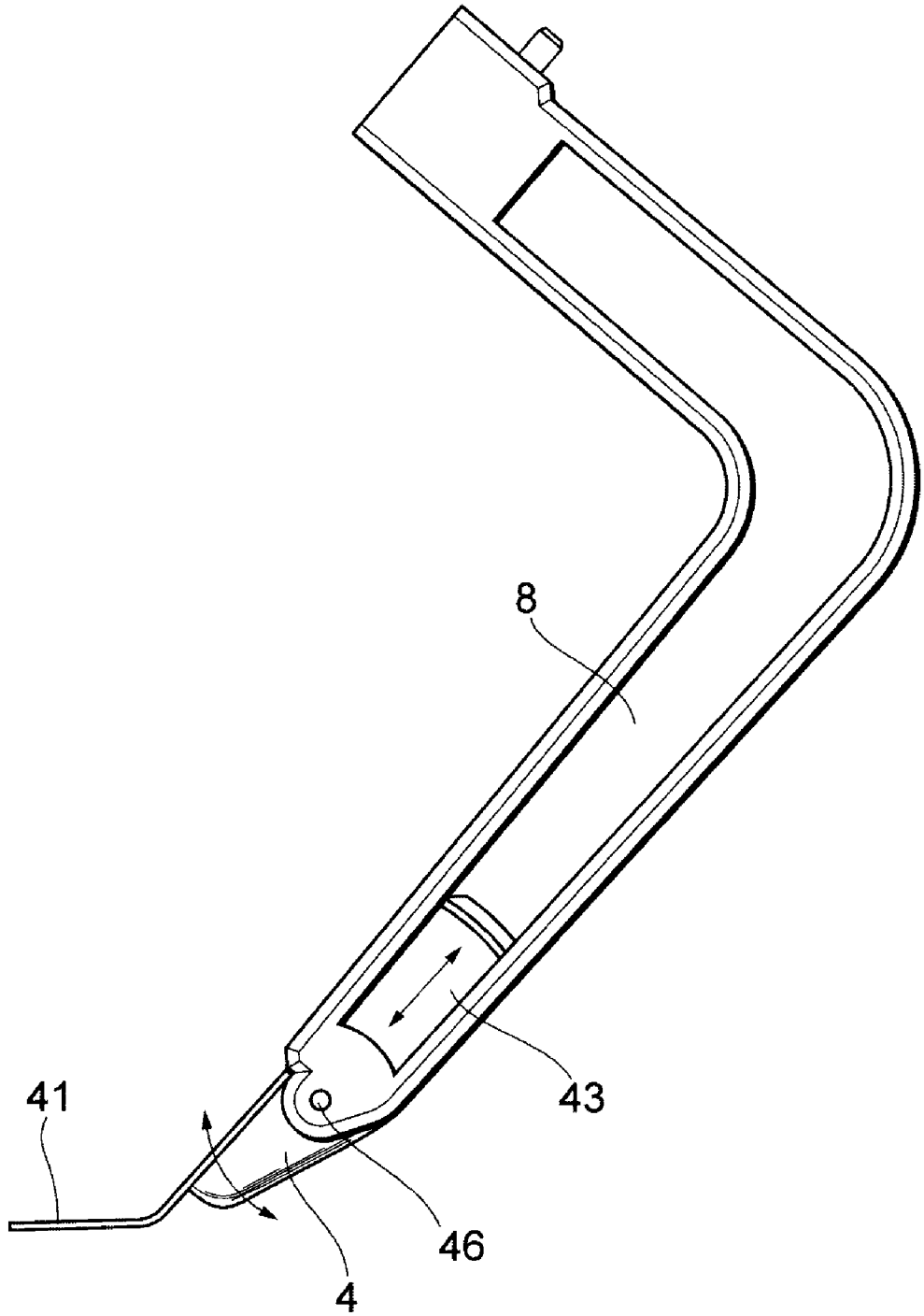
FIG. 22 is a diagram showing another form of claw angle adjusting means and shows the whole arm.

Here, another configuration example of a claw angle adjusting means 42 will be represented in FIG. 22 and the like, and a description thereof is followed below (see FIGS. 22 to 25).

The claw angle adjusting means 42 is configured to be switchable between a restricted state in which the turning operation of the claw member 4 relative to the arm 8 is restricted and a non-restricted state in which the turning operation of the claw member 4 is allowed, by user's operating the slider 43, which is the same as that described above. However, in this embodiment, a plurality of the engaging holes (hole portions) 43*a*' is disposed in the slider 43, and the turning operation of the claw member 4 is restricted by inserting a protrusion portion 44' disposed in the claw member 4 into any one of the engaging holes 43*a*' (see FIG. 24 and the like).

Figure 23:
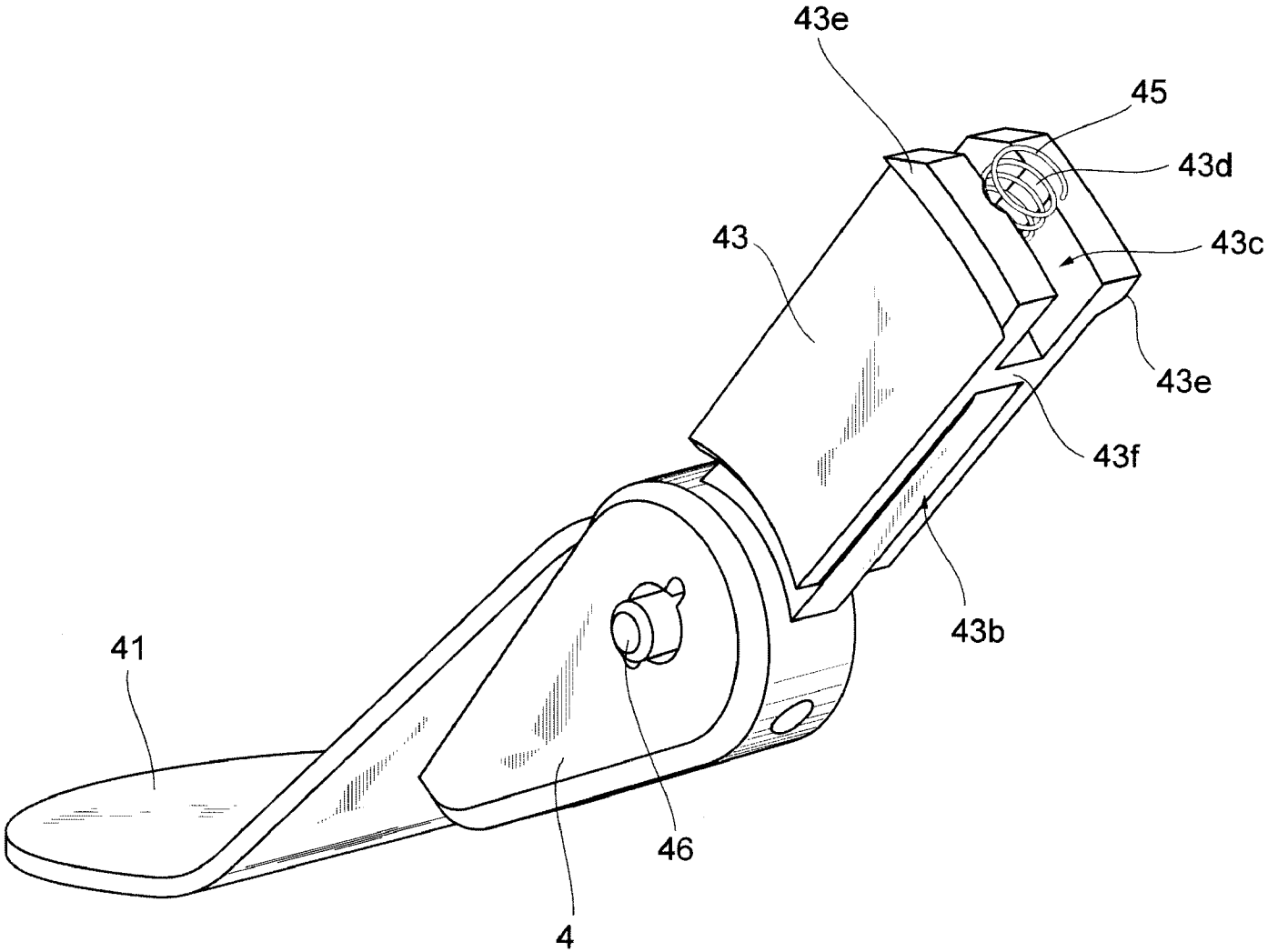
FIG. 23 is a perspective view showing the structure of a claw member and a slider.
Figure 24:
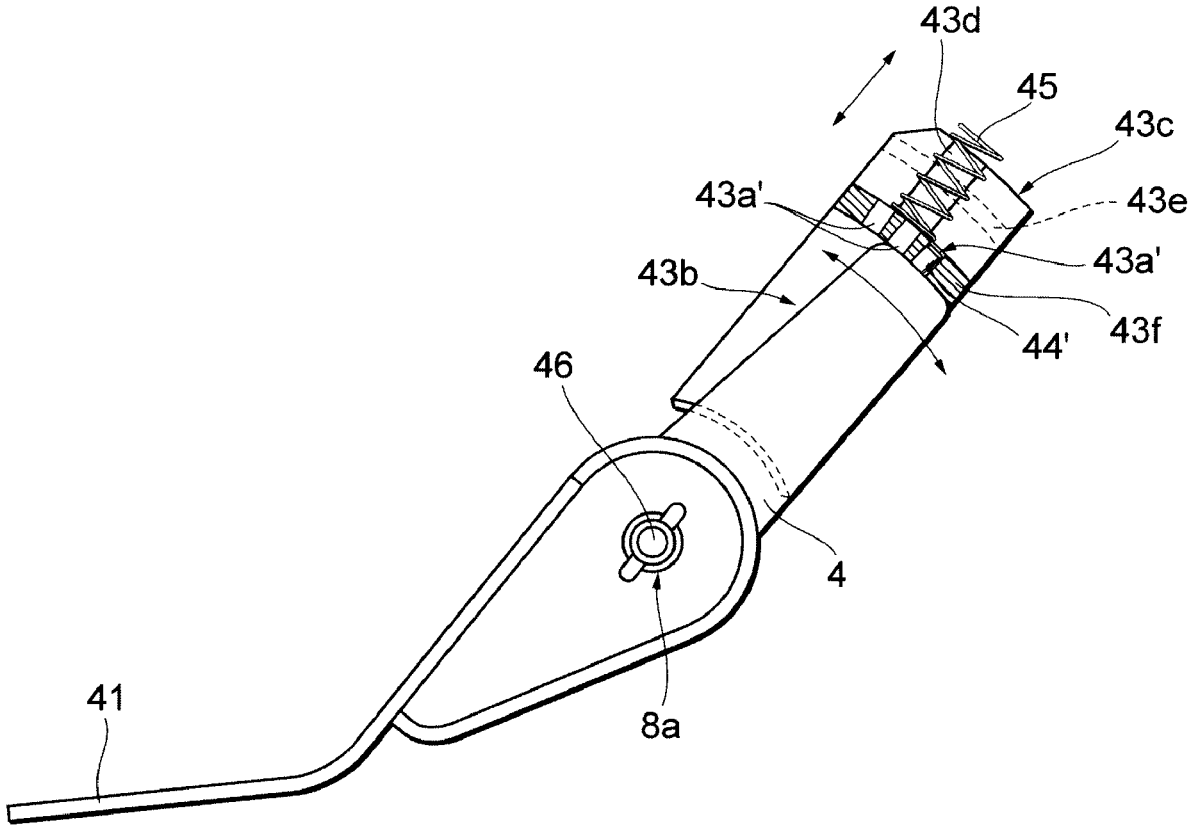
FIG. 24 is a diagram representing the internal structure of a slider by showing a cross-section of the slider.

The slider 43 according to this embodiment is formed in the shape of an approximate letter "H" in which grooves 43*b* and 43*c* are formed on the claw member 4 side and the arm 8 side (see FIG. 23). Between these grooves, the groove 43*b* is formed to have a width for fitting a portion (a portion on the arm side) of the claw member 4. In the groove 43*c*, a biasing member 45, for example, formed of a coil spring that biases the slider 43 to the claw member 4 side relative to the arm 8 is disposed. In addition, in the groove 43*c*, a holding groove 43*d* in the shape of a circular arc which is used for holding the biasing member 45 not to be deviated in position is formed (see FIG. 23 and the like). On both sides of the slider 43, stair parts 43*e* that allow a user to easily perform a sliding operation of the slider 43 are disposed (see FIG. 23 and the like).

In addition, as described above, in the slider 43, a plurality of engaging holes 43*a*' is disposed. For example, in this embodiment, in a bridge part 43*f* that is fitted in the grooves 43*b* and 43*c*, for example, three engaging holes 43*a*' are disposed (see FIG. 24). The three engaging holes 43*a*' are disposed such that the angle of the claw member 4 can be changed, for example, by 5° each time by using a fulcrum point 8*a* as the center. The shape and size of each engaging hole 43*a*' is not particularly limited as long as the protrusion part 44' can be inserted into the engaging hole 43*a*' and the restricted state of the turning operation of the claw member 4 relative to the arm 8 can be maintained by the engaging hole 43*a*'. In addition, as in this embodiment, the engaging holes 43*a*' may be configured to perforate the bridge part 43*f*, or the engaging holes 43*a*' may be configured not to perforate the bridge part 43*f* and end in the middle. In addition, in order to allow a user to easily insert the protrusion part 44' into the engaging holes, it is preferable that edge of the entrance of each engaging hole 43*a*' is chamfered (see FIG. 24).

Figure 25:
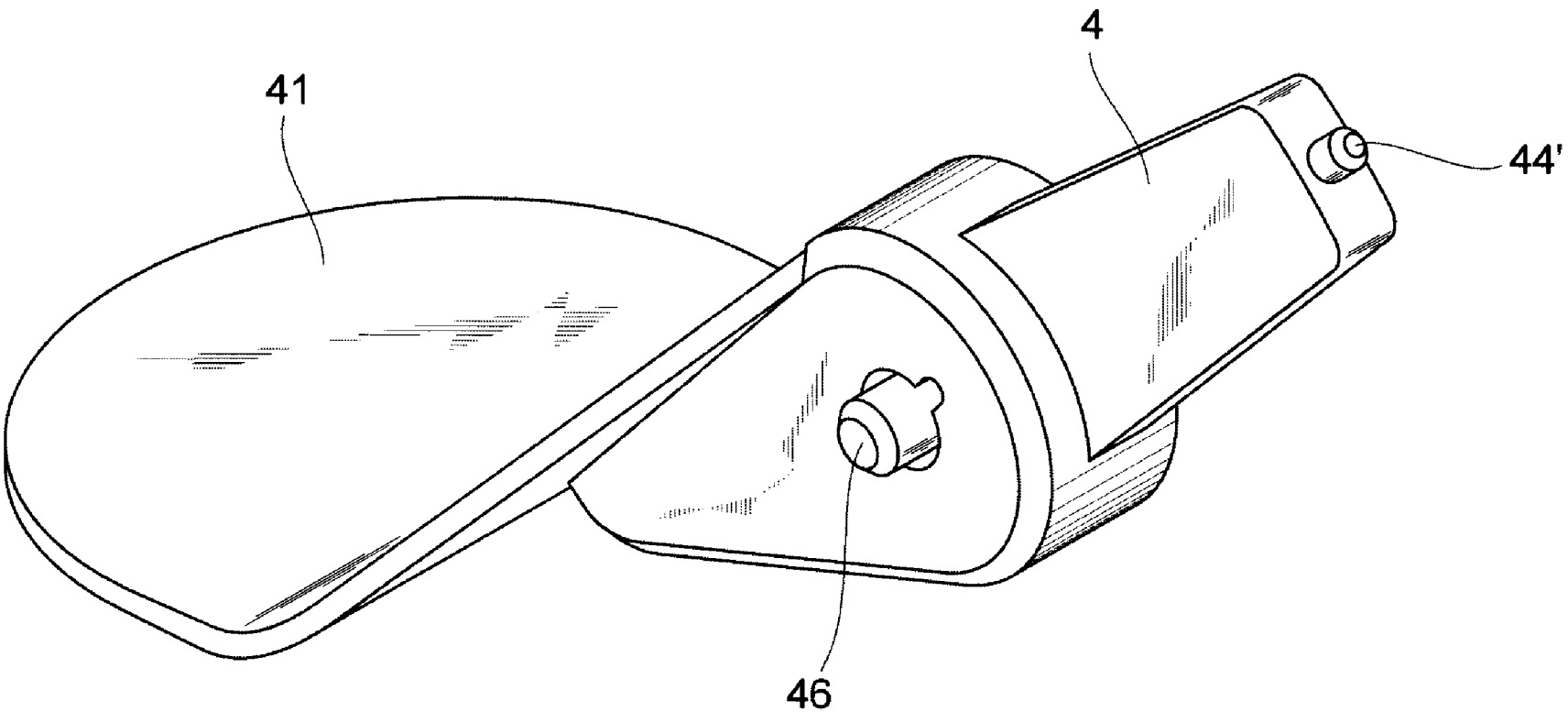
FIG. 25 is a diagram representing the internal structure of a slider by showing a cross-section of the slider.

The protrusion part 44' is formed in an end portion of the claw member 4 on the arm 8 side, and accordingly, a state in which the turning operation of the claw member 4 relative to the arm 8 is restricted is formed by inserting the protrusion part 44' into any one of the above-described engaging holes 43*a* (see FIG. 25 and the like). In order to allow a user to easily insert the protrusion part 44' into the engaging holes 43*a*', it is preferable that edge of the end of the protrusion part 44' is chamfered to be in the shape of a taper (see FIG. 25 and the like).

As described above, under the structure according to this embodiment, the claw member 4 is configured to be able to turn relative to the arm 8, and the claw angle adjusting means 42 that restricts or allows the turning operation of the claw member 4 can be switchable by a manual operation. Accordingly, for example, a user such as a service provider or the like can change the angle of the claw member 4 with respect to the arm 8 in a simple manner without using a tool or the like. In particular, the relative angle of the claw member 4 (and the claw 41) with respect to the arm 8 can be adjusted in a simple manner by user's manually moving the slider 43 so as to be switched to the non-restricted state, changing the relative angle of the claw member 4, and then manually switching the slider 43 back to the restricted state.

In addition, in the claw angle adjusting means 42 having the above-described structure, since the protrusion part 44' and the engaging holes 43*a*' are formed in the claw member 4 and the slider 43, an engagement part 43, a stair part 44, or a portion corresponding thereto is not needed to be provided in the arm 8. In such a case, there is an advantage that a molding process for the arm 8 is not complicated much. Although the engaging holes 43*a*' are formed in the slider 43 and the protrusion part 44' is formed in the claw member 4, the configurations thereof are not limited thereto. Thus, it may be configured that the protrusion part is formed in the slider 43 and the engaging holes are formed in the claw member 4.

(3) Internal Configuration of Prize Acquisition Game Device 1

Figure 4:
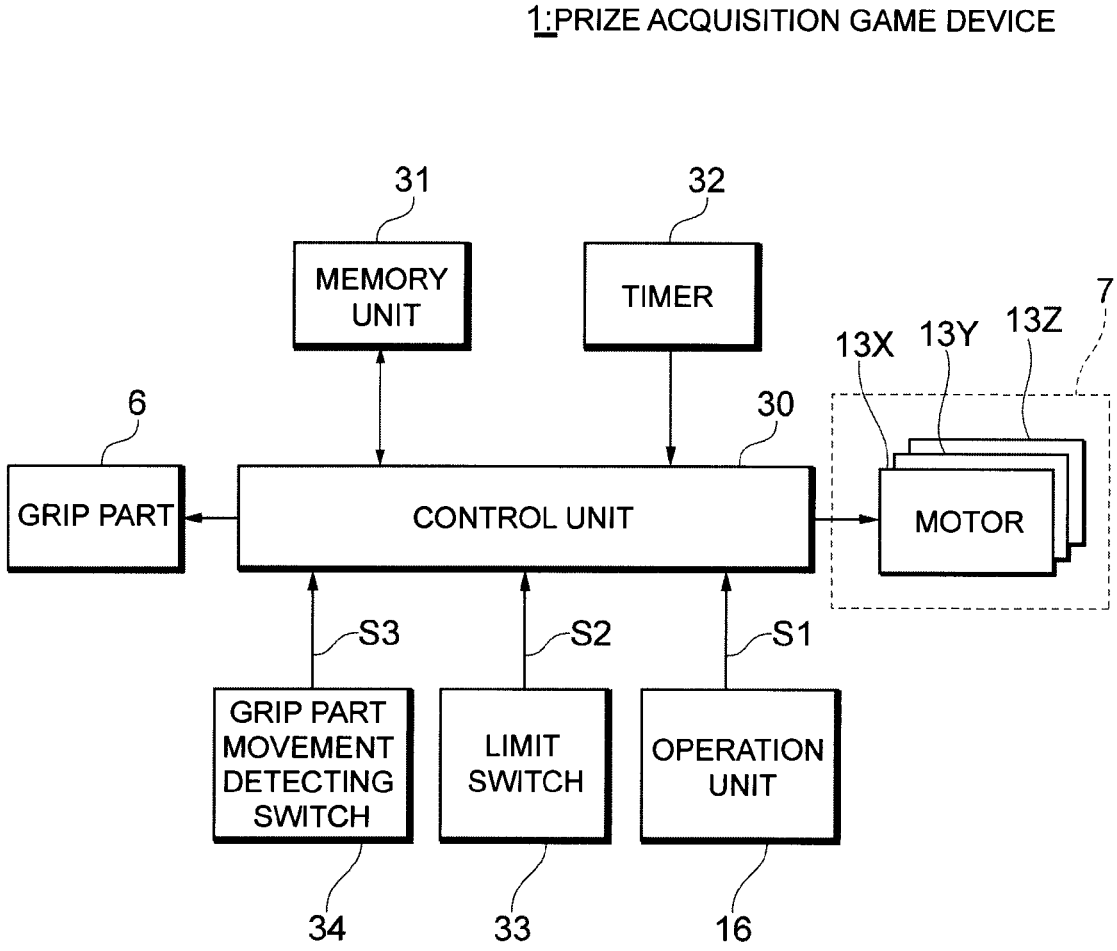
FIG. 4 is a block diagram showing the internal configuration of a prize acquisition game device.

FIG. 4 represents the internal configuration of the prize acquisition game device 1. As shown in FIG. 4, the prize acquisition game device 1 includes a control unit 30 having the configuration of a micro computer that is configured by a CPU (Central Processing Unit), a ROM (Read Only Memory), and a RAM (Random Access Memory), a memory unit 31 that is, for example, configured by a non-volatile memory, and a timer 32 that counts the current time.

When the first operation switch 16A or the second operation switch 16B of the control unit 16 in the control panel 14 (see FIG. 1) is pressed by a player, for example, during a game, a corresponding operation signal S1 is transmitted from the first or second operation switch 16A or 16B to the control unit 30.

In addition, in the movement part 7, limit switches 33 that are, for example, disposed in positions of the origins of the grip part 6 in direction X, direction Y, and direction Z of the grip part 6 or positions of movement limits of the grip part 6 for direction X, direction Y, and direction Z are provided as X-direction position detecting means for detecting the position of the grip part 6 for direction X, Y-direction position detecting means for detecting the position of the grip part 6 for direction Y, and Z-direction position detecting means for detecting the position of the grip part 6 for direction Z are provided. When the grip part 6 is moved to the position of the origin in direction X, direction Y, or direction Z or the position of the movement limit for direction X, direction Y, or direction Z, a corresponding limit switch 33 is configured to transmit a corresponding movement limit detecting signal S2 to the control unit 30.

As described above, the control unit 30 can allow the prize acquisition game device 1 to perform a game operation in response to a player's operation of the first and second operation switches 16A and 16B based on the operation signal S1 and the movement limit detecting signal S2.

In addition, the control unit 30 measures a time period in which the second operation button 16B is pressed. When the pressed time period of the second operation button is longer than one second, the control unit 30 stops the movement of the prize acquisition base pedestal 11 in the vertical direction (to the origin side) along the Y-direction movement movable rail 10 in a time period that is shorter than the pressed time period by one second.

As described above, the control unit 30 stops the movement of the prize acquisition base pedestal 11 in the vertical direction (to the origin side) along the Y-direction movement movable rail 10 in a time period that is, for example, shorter than the pressed time period by one second, in accordance with a case where a prize of a size larger than that of a common prize P is gripped by the grip part 6. Accordingly, it can be efficiently prevented that the grip part 6 drops a prize due to collision of the prize P gripped by the grip part 6 with the inner side of the front face 5A of the prize acquisition game device 1, in advance.

On the other hand, when the pressed time period of the second operation button is, for example, within one second, the control unit 30 is configured not to move the prize acquisition base pedestal 11 in the vertical direction (to the origin side) along the Y-direction movement movable rail 10.

Figure 5:
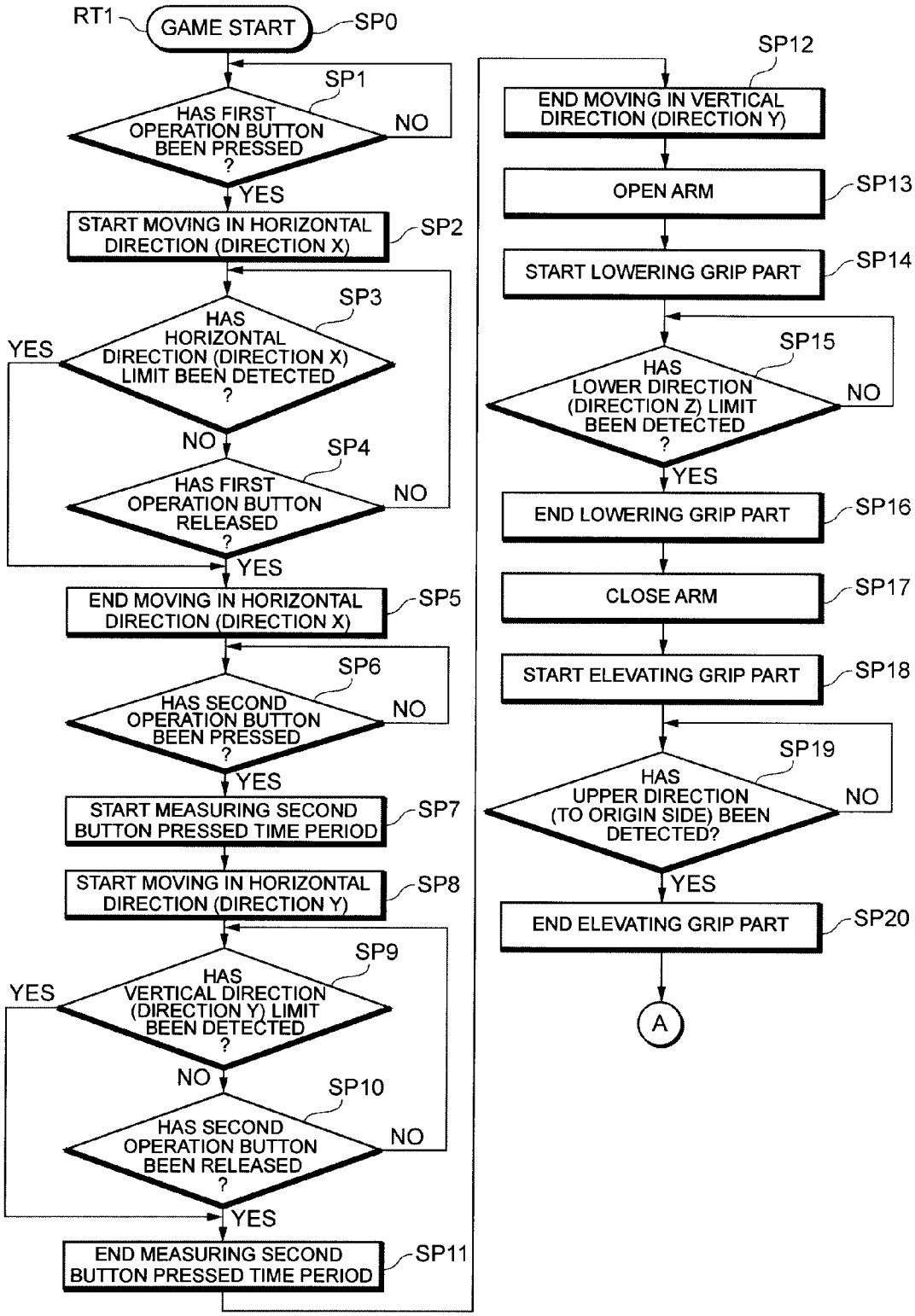
FIG. 5 is a flowchart showing a prize acquisition game performing sequence.
Figure 6:
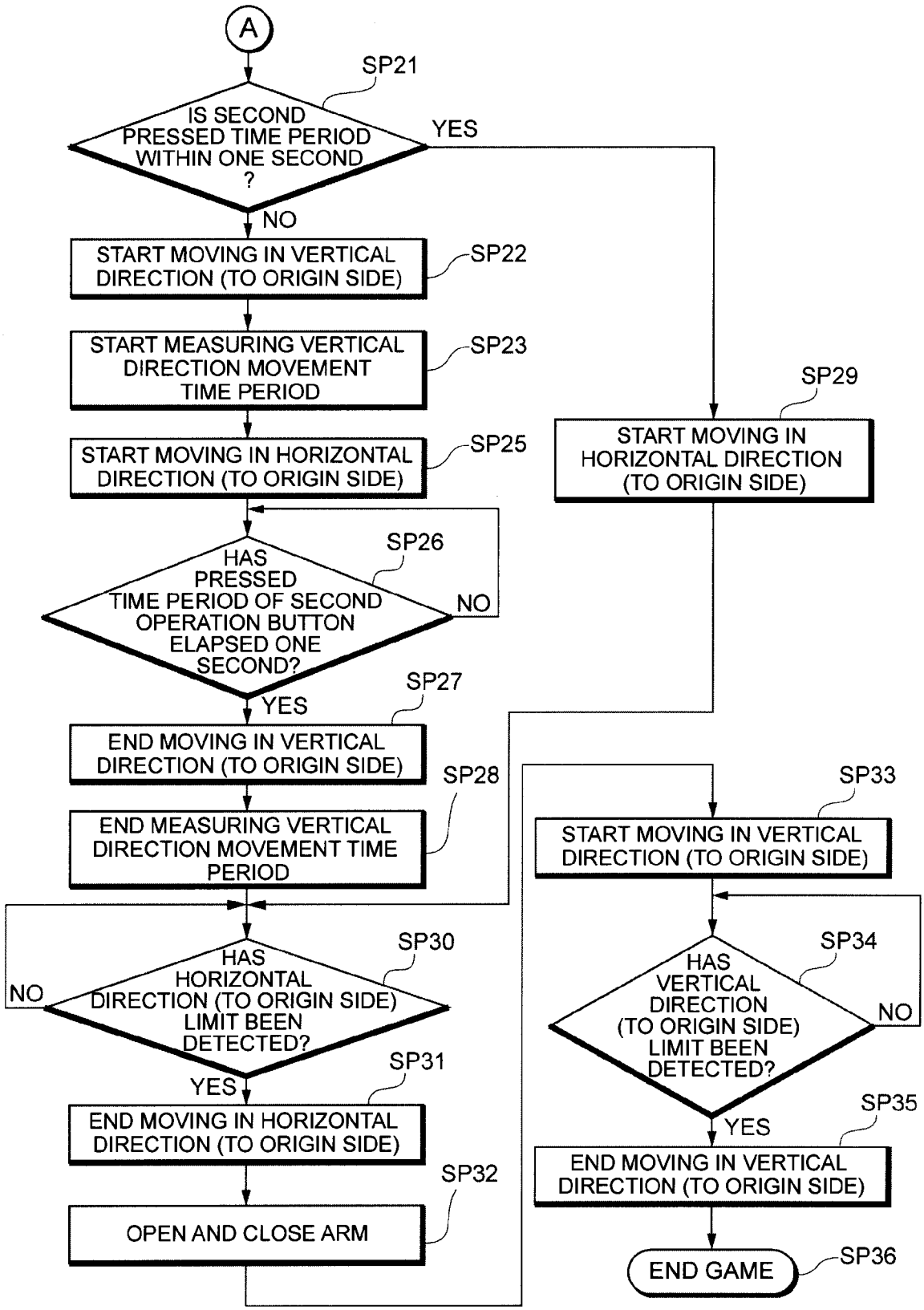
FIG. 6 is a flowchart showing a prize acquisition game performing sequence.

Here, when recognizing that coins of a predetermined number corresponding to one play set in advance have been inserted into the coin insertion slot 15 (FIG. 1), the control unit 30 starts a prize acquisition game performing sequence RT1 shown in FIG. 5 in Step SP0. Next, in Step SP1, the control unit 30 waits for the first operation button 16A in the control panel 14 to be pressed.

Then, when the control unit 30 recognizes that the player has pressed the first operation button 16A based on the operation signal S1 from the first operation button 16A, the process proceeds to Step SP2, and the control unit 30 operates the X-direction movement motor 13X of the movement part 7 (see FIG. 2) and starts movement of the grip part 6, which is located at the home position (origin) right above the prize insertion guide 17 (see FIG. 1) in the initial state, in the horizontal direction (direction X).

Then, the process proceeds to Step SP3, and the control unit 30 determines whether the grip part 6 has moved to the movement limit position for the horizontal direction (direction X) based on the movement limit detecting signal S2 from the limit switch 33 for the horizontal direction (direction X). Next, in Step SP4, the control unit 30 determines whether the first operation button 16A has been released based on the operation signal S1 from the first operation button 16A. Then, when all negative results are acquired in Steps SP3 and SP4, the control unit 30 proceeds back to Step SP3.

On the other hand, when acquiring a positive result in any one of Step SP3 or Step SP4, the control unit 30 proceeds to Step SP5 and ends the movement of the grip part 6 in the horizontal direction (direction X) by stopping the X-direction movement motor 13X of the movement part 7. Thereafter, the control unit 30 proceeds to Step SP6 and waits for the second operation button 16B in the control panel 14 to be pressed.

When recognizing press of the second button 16B based on the operation signal S1 from the second operation button 16B, the control unit 30 proceeds to Step SP7 and starts measuring a pressed time period of the second operation button 16B based on the current time of the timer 32. Next, in Step SP8, the control unit 30 starts movement of the grip part 6 in the vertical direction (direction Y) by operating the Y-direction movement motor 13Y of the movement part 7.

Thereafter, the process proceeds to Step SP9, and the control unit 30 determines whether the grip part 6 has moved to the movement limit position for the vertical direction (direction Y) based on the movement limit detecting signal S2 from the limit switch 33 for the vertical direction (direction Y). Next, in Step SP10, the control unit 30 determines whether the second operation button 16B has been released based on the operation signal S1 from the second operation button 16B. Then, when all negative results are acquired in Steps SP8 and SP9, the control unit 30 proceeds back to Step SP9.

On the other hand, when acquiring a positive result in any one of Step SP9 or Step SP10, the control unit 30 proceeds to Step SP111. In Step SP11, the control unit 30 ends measurement of the pressed time period of the second operation button 16B. Next, in Step SP12, the control unit 30 ends the movement of the grip part 6 in the vertical direction (direction Y) by stopping the Y-direction movement motor 13Y of the movement part 7.

Then, the control unit 30 proceeds to Step SP13 and opens the arm 8 of the grip part 6 by operating the motor (not shown) of the grip part 6.

Then, the control unit 30 proceeds to Step SP14 and starts lowering the grip part 6 by operating the Z-direction movement motor 13Z (see FIG. 4) of the movement part 7. Thereafter, the control unit 30 proceeds to Step SP15 and waits for the grip part 6 to complete movement to the movement limit position for the lower direction (direction Z).

When recognizing that the grip part 6 has moved to the movement limit position for the lower direction (direction Z) based on the movement limit detecting signal S2 from the limit switch 33 for the lower direction (direction Z), the control unit 30 proceeds to Step SP16 and ends lowering the grip part 6 by stopping the Z-direction movement motor 13Z of the movement part 7. Thereafter, the control unit 30 proceeds to Step SP17 and closes the arm 8 by operating the motor (not shown) of the grip part 6.

Subsequently, the control unit 30 proceeds to Step SP18 and starts elevating the grip part 6 by operating the Z-direction movement motor 13Z of the movement part 7. Then, the control unit 30 proceeds to Step SP19 and waits for the grip part 6 to complete its movement to the movement limit position for the upper direction (to the origin side).

Then, when checking that the grip part 6 has completed its movement to the movement limit position for the upper direction based on the movement limit detecting signal S2 from the limit switch 33 for the lower direction (to the origin side), the control unit 30 proceeds to Step SP20 and ends elevating the grip part 6 by stopping the Z-direction movement motor 13Z of the movement part 7.

Thereafter, the control unit 30 proceeds to Step SP21 and determines whether the pressed time period of the second operation button 16B which is measured in Steps SP7 to SP11 is within one second. Then, when receiving a negative result in Step SP21, the control unit 30 proceeds to Step SP22 and starts movement of the grip part 6 in the vertical direction (to the origin side) by operating the Y-direction movement motor 13Y of the movement part 7.

Thereafter, the control unit 30 proceeds to Step SP23 and starts measuring a time period (hereinafter, referred to as a vertical-direction movement time period) after starting the movement of the grip part 6 in the vertical direction (to the origin side) on the basis of the current time of the timer 32.

Subsequently, the control unit 30 starts movement in the horizontal direction (to the origin side) (Step SP25) and determines whether the vertical-direction movement time period has elapsed a time that is acquired from subtracting one second from the pressed time period of the second operation button 16B (Step SP26). Then, when a negative result is acquired in Step SP26, the control unit 30 waits for the elapse of (the pressed time period of the second operation button−1) seconds. When a positive result is finally acquired in Step SP26, the control unit proceeds to Step SP27 and ends the movement of the grip part 6 in the vertical direction (to the origin side) by stopping the Y-direction movement motor 13Y of the movement part 7. Thereafter, the control unit 30 proceeds to Step SP28 and ends the measurement of the horizontal-direction movement time period.

On the other hand, when receiving a positive result in Step SP21, the control unit 30 proceeds to Step SP29 and starts movement of the grip part 6 in the horizontal direction (to the origin side) by operating the X-direction movement motor 13X of the movement part 7.

Thereafter, the control unit 30 proceeds to Step SP30 and determines whether the grip part 6 has completed its movement to the movement limit position for the horizontal direction based on the movement limit detecting signal S2 from the limit switch 33 for the horizontal direction (to the origin side). Then, when receiving a negative result in Step SP30, the control unit 30 waits for the grip part 6 to complete its movement to the movement limit position for the horizontal direction (to the origin side). When a positive result is finally acquired in Step SP30, the control unit proceeds to Step SP31 and ends the movement of the grip part 6 in the horizontal direction (to the origin side) by stopping the X-direction movement motor 13X of the movement part 7.

Thereafter, the control unit 30 proceeds to Step SP32 and opens the arm 8 of the grip part 6 by operating the motor (not shown) of the grip part 6 and then closes the arm 8 back (a release operation of the prize P).

Thereafter, the control unit 30 proceeds to Step SP33 and starts the movement of the grip part 6 in the vertical direction (to the origin side) by operating the Y-direction movement motor 13Y of the movement part 7. Thereafter, the control unit 30 proceeds to Step SP34 and determines whether the grip part 6 has completed its movement to the movement limit position for the vertical direction based on the movement limit detecting signal S2 from the limit switch 33 for the vertical direction (to the origin side). Then, when receiving a negative result in Step SP34, the control unit 30 waits for the grip part 6 to complete its movement to the movement limit position for the vertical direction (to the origin side). When a positive result is finally acquired in Step SP34, the control unit proceeds to Step SP35 and ends the movement of the grip part 6 in the vertical direction (to the origin side) by stopping the Y-direction movement motor 13Y of the movement part 7.

As a result, the control unit 30 has completed movement of the grip part 6 to the movement limit position for the vertical direction and the movement limit position for the horizontal direction. This operation represents that the grip part 6 is located at the home position right above the prize insertion guide 17.

Finally, the control unit 30 proceeds to Step SP36 and completes the prize acquisition game performing sequence RT1.

As described above, according to the prize acquisition game device 1, when a prize P is gripped (including a case where a part of the prize P is hooked and lifted) by the grip part 6, the prize P is moved above the prize insertion guide 17 in a state that the prize P is caught by the arm 8 of the grip part 6. Thereafter, the prize is dropped inside the prize insertion guide 17 by a release operation of the grip part 6 for the prize P, and accordingly the player can acquire the prize P by taking it out from the prize take-out opening 18.

The above-described embodiments are merely examples of appropriate embodiments of the present invention, and the present invention is not limited thereto. Thus, various changes in forms can be made therein without departing from the gist of the present invention. For example, in the above-described embodiments, although the slider 43 constituting the claw angle adjusting means 42 is configured to be moved along the claw member 4, a configuration described below as an example may be used. The claw angle adjusting means 42 can be configured by using a slider 43 that is movable between the restricted position for restricting the turning operation of the claw member 4 and the non-restricted position for allowing the turning operation of the claw member 4 within the arm 8 along the longitudinal direction of the arm 8 (see FIGS. 17 to 21).

In such a case, the engagement part 43*a* is formed in a part (a part on the claw member 4 side) of the slider 43. In addition, in the base end portion of the claw member 4, the stair part 44 in which the engagement part 43*a* is engaged is formed (see FIG. 21 and the like). The shapes of the engagement part 43*a* and the stair part 44 may be the same as those described in the above-described embodiments. However, in this embodiment, as an example, the shapes thereof are formed like gears. In other words, a plurality (for example, five to six) of engaging grooves 44*a* is formed in the shape of an approximate saw in the claw member 4, and thus, the stair part 44 in a gear-like shape is used (see FIG. 21 and the like). In addition, the engagement part 43*a* of the slider 43 is formed in a gear-like shape similarly (see FIG. 21 and the like). As a result, in the claw angle adjusting means 42 according to this embodiment, gear-shaped engagement parts (the engagement part 43*a* and the stair part 44) including a plurality of saws are engaged with each other in the restricted state, and accordingly, the restricted state can be easily maintained. In addition, in any restricted state, at least a plurality of saws are engaged with each other, and accordingly, the state in which the turning operation of the claw member 4 is restricted can be easily maintained. In addition, when the number of the saws is configured to be large to some degree (to shorten the pitch of the saws), the amount of a change in the angle for a case where the engagement part 43*a* is deviated by one step can be decreased further, and accordingly, adjustment of a smaller angle can be performed.

Figure 21:
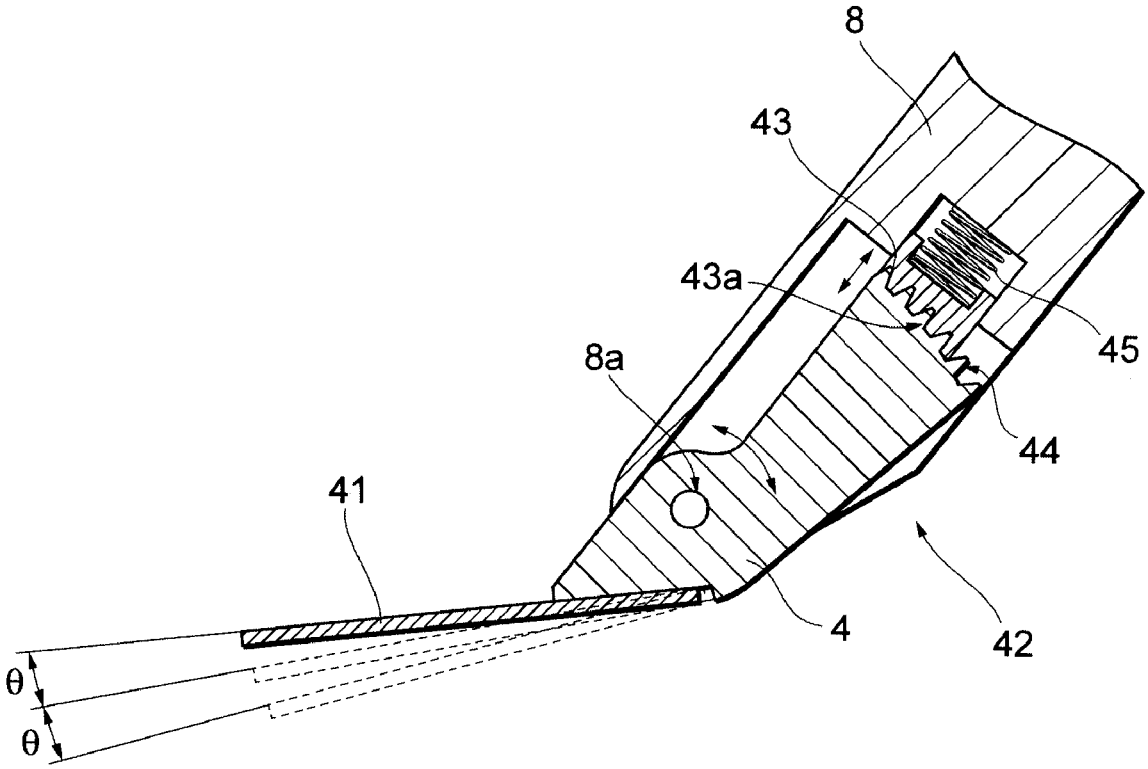
FIG. 21 is an enlarged cross-section view of a portion enclosed by a circle shown in FIG. 20.

In addition, also in this embodiment, the slider 43 is configured to be biased to the stair part 44 side by using the biasing member 45, for example, formed of a coil spring (see FIG. 21 and the like). Accordingly, the engagement part 43*a* and the stair part 44 are engaged with each other, and thus, the restricted state in which the claw member 4 is not turned can be easily maintained.

In addition, in this embodiment, depths of saws of the engagement part 43*a* and the engaging grooves 44*a* are formed to be large to some degree, and thus, the engagement part 43*a* and the engaging grooves 44*a* are configured not to be easily separated (see FIG. 21 and the like). However, the saws of the engagement part 43*a* and the engaging grooves 44*a* may be formed to be shallow. When the peaks and troughs are formed in a gentle shape by forming the saws to be shallow to some degree, the claw angle can be adjusted by retreating the slider 43 along the shapes of the peaks and troughs of the saws by applying a force in the turning direction of the claw member 4 without performing an operation for pulling the slider 43. In such a case, although the biasing force applied by the biasing member 45 may be needed to be appropriately adjusted, it is convenient that the claw angle can be adjusted without performing operations for pulling and returning the slider 43.

In the above-described prize acquisition game device 1, although the color and the like of the arm 8 have not been particularly described, the arm 8 may be formed of a translucent or opaque member. As described above, when a part or the whole of the arm 8 is formed of such a member, at least a part of the claw angle adjusting means 42, that is, the stair part 44 and the biasing member 45 formed inside the arm 8, can be configured not visible well or completely not visible. For example, when the configuration of the claw angle adjusting means 42 is desired not be visible or adjustability of the claw angle is desired to be unknown, such a structure may be used.

INDUSTRIAL APPLICABILITY

The present invention is appropriately applicable particularly to a prize acquisition game device used for a player to acquire a prize by moving a movement rail.

What is claimed is:

1. A prize acquisition game device that can perform a game for gripping and acquiring a prize, the prize acquisition game device comprising:

a grip part that is moved in a predetermined space in response to an external operation;

an arm that is attached to the grip part to be able to be opened or closed and performs an operation for gripping the prize as a target for acquisition or separating the gripped prize;

a claw member that is attached to an end portion of the arm; and claw angle adjusting means that is switchable between a restricted state in which a relative angle of the claw member with respect to the arm is fixed by restricting a turning operation of the claw member relative to the arm and a non-restricted state in which the relative angle can be changed by allowing the turning operation of the claw member by a user's manual operation, wherein the claw member is disposed to be able to turn relative to the arm in the direction for opening or closing the arm, and wherein the claw angle adjusting means includes a slider that can be moved between a restricted position for restricting the turning operation of the claw member and a non-restricted position for allowing the turning operation of the claw member.

2. The prize acquisition game device according to claim 1, further comprising a stair part having a plurality of steps in which an engagement part that is a part of the slider is engaged for switching the claw angle adjusting means to the restricted state.

3. The prize acquisition game device according to claim 1, further comprising a biasing member that biases the slider to the restricted position side.

4. The prize acquisition game device according to claim 2, wherein the stair part is shaped to include an engaging hole having a width slightly smaller than the engagement part of the slider that is inserted into the stair part to be in an engaged state and serving to prevent the engagement part from being easily disengaged.

5. The prize acquisition game device according to claim 2, wherein the stair part is disposed in the slider and is engaged with an end portion of the claw member.

6. The prize acquisition game device according to claim 1, wherein the width of the slider in the direction for opening or closing the arm is smaller than that of the arm, and wherein the slider is disposed such that both sides of the slider are positioned on the inner side relative to both sides of the arm.

7. A prize acquisition game device that can perform a game for gripping and acquiring a prize, the prize acquisition game device comprising:

a grip part that is moved in a predetermined space in response to an external operation;

an arm that is attached to the grip part to be able to be opened or closed and performs an operation for gripping the prize as a target for acquisition or separating the gripped prize;

a claw member that is attached to an end portion of the arm; and claw angle adjusting means including: a slider that can be moved along the claw member between a restricted position for restricting a turning operation of the claw member and a non-restricted position for allowing the turning operation of the claw member; a stair part having a plurality of steps formed in the arm so as to restrict the turning operation of the claw member by being engaged with an engagement part that is a part of the slider; and a biasing member that biases the slider to the restricted position for engaging the slider with the stair part, wherein the claw member is disposed to be able to turn relative to the arm in the direction for opening or closing the arm.

8. A prize acquisition game device that can perform a game for gripping and acquiring a prize, the prize acquisition game device comprising:

a grip part that is moved in a predetermined space in response to an external operation;

an arm that is attached to the grip part to be able to be opened or closed and performs an operation for gripping the prize as a target for acquisition or separating the gripped prize;

a claw member that is attachedend portion of the arm; and claw angle adjusting means including: a slider that can be moved between a restricted position for restricting a turning operation of the claw member and a non-restricted position for allowing the turning operation of the claw member within the arm; a stair part having a plurality of steps formed in the claw member so as to restrict the turning operation of the claw member by being engaged with an engagement part that is a part of the slider; and a biasing member that biases the slider to the restricted position for engaging the slider with the stair part, wherein the claw member is disposed to be able to turn relative to the arm in the direction for opening or closing the arm.

9. The prize acquisition game device according to any one of claims 7 and 8, wherein a resistance reducing portion in the shape corresponding to the direction for opening or closing the arm is formed in at least a part of a claw that is formed in the claw member.

10. The prize acquisition game device according to any one of claims 7 and 8, wherein a claw formed in the claw member is formed to have a cross-section in the shape that is concave or convex to the lower side in the vertical direction in a state that the claw can grip the prize.

11. A prize acquisition game device comprising:

a grip part that is moved in a predetermined space in response to an external operation;

an arm that is attached to the grip part to be able to be opened or closed and performs an operation for gripping the prize as a target for acquisition or separating the gripped prize;

a claw member that is attached to an end portion of the arm to be able to turn; and claw angle adjusting means that is configured to change an angle of the claw member with respect to the arm, wherein the claw angle adjusting means is configured to be able to move a slider disposed in the arm along the arm between a restricted position for a restricted state in which a relative angle of the claw member with respect to the arm is fixed by restricting a turning operation of the claw member relative to the arm and a non-restricted position for a non-restricted state in which the relative angle is allowed to be changed by allowing the turning operation of the claw member, and wherein the claw angle adjusting means is configured to change the angle of the claw member with respect to the arm as a protrusion part of the claw member is fitted in a hole portion by moving the slider from the restricted position to the non-restricted position, then, turning the claw member that is in the non-restricted state from the restricted state relative to the arm such that the protrusion part of the claw member is fitted in anyone hole portion selected from a plurality of hole portions disposed in a part of the slider, and moving the slider from the non-restricted position to the restricted position.

12. A prize acquisition game device comprising:

a grip part that is moved in a predetermined space in response to an external operation;

an arm that is attached to the grip part to be able to be opened or closed and performs an operation for gripping the prize as a target for acquisition or separating the gripped prize;

a claw member that is attached to an end portion of the arm to be able to turn; and claw angle adjusting means that is configured to change an angle of the claw member with respect to the arm, wherein the claw angle adjusting means is configured to be able to move a slider disposed in the arm along the arm between a restricted position for a restricted state in which a relative angle of the claw member with respect to the arm is fixed by restricting a turning operation of the claw member relative to the arm and a non-restricted position for a non-restricted state in which the relative angle is allowed to be changed by allowing the turning operation of the claw member, and wherein the claw angle adjusting means is configured to change the angle of the claw member with respect to the arm as one hole portion is engaged with a protrusion part by moving the slider from the restricted position to the non-restricted position, then, turning the claw member that is in the non-restricted state from the restricted state relative to the arm such that anyone hole portion selected from among a plurality of hole portions disposed in the claw member is engaged with the protrusion part disposed in a part of the slider, and moving the slider from the non-restricted position to the restricted position.

13. A prize acquisition game device that can perform a game for gripping and acquiring a prize, the prize acquisition game device comprising:

a grip part that is moved in a predetermined space in response to an external operation;

an arm that is attached to the grip part to be able to be opened or closed and performs an operation for gripping the prize as a target for acquisition or separating the gripped prize;

a claw member that is attached to an end portion of the arm; and claw angle adjusting means that is switchable between a restricted state in which a relative angle of the claw member with respect to the arm is fixed by restricting a turning operation of the claw member relative to the arm and a non-restricted state in which the relative angle can be changed by allowing the turning operation of the claw member by a user's manual operation, wherein the claw member is disposed to be able to turn relative to the arm in the direction for opening or closing the arm, and wherein a resistance reducing portion in the shape corresponding to the direction for opening or closing the arm is formed in at least a part of a claw that is formed in the claw member.

14. A prize acquisition game device that can perform a game for gripping and acquiring a prize, the prize acquisition game device comprising:

a grip part that is moved in a predetermined space in response to an external operation;

an arm that is attached to the grip part to be able to be opened or closed and performs an operation for gripping the prize as a target for acquisition or separating the gripped prize;

a claw member that is attached to an end portion of the arm; and claw angle adjusting means that is switchable between a restricted state in which a relative angle of the claw member with respect to the arm is fixed by restricting a turning operation of the claw member relative to the arm and a non-restricted state in which the relative angle can be changed by allowing the turning operation of the claw member by a user's manual operation;

wherein the claw member is disposed to be able to turn relative to the arm in the direction for opening or closing the arm, and wherein a claw formed in the claw member is formed to have a cross-section in the shape that is concave or convex to the lower side in the vertical direction in a state that the claw can grip the prize.

* * * * *